US008456391B2

(12) United States Patent
Yatabe et al.

(10) Patent No.: US 8,456,391 B2
(45) Date of Patent: Jun. 4, 2013

(54) PIXEL CIRCUIT DRIVING METHOD, LIGHT EMITTING DEVICE, AND ELECTRONIC APPARATUS INCLUDING A VARIABLE DRIVING SIGNAL

(75) Inventors: Satoshi Yatabe, Shiojiri (JP); Hideto Ishiguro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 382 days.

(21) Appl. No.: 12/545,479

(22) Filed: Aug. 21, 2009

(65) Prior Publication Data

US 2010/0079507 A1 Apr. 1, 2010

(30) Foreign Application Priority Data

Sep. 29, 2008 (JP) ..... 2008-249809

(51) Int. Cl.
*G09G 3/32* (2006.01)

(52) U.S. Cl.
USPC ..... 345/82

(58) Field of Classification Search
USPC ..... 345/82, 76, 208
See application file for complete search history.

(56) References Cited

U.S. PATENT DOCUMENTS

| | | | | |
|---|---|---|---|---|
| 7,106,285 | B2 | 9/2006 | Naugler | |
| 7,129,938 | B2 | 10/2006 | Naugler, Jr. et al. | |
| 2003/0142048 | A1* | 7/2003 | Nishitani et al. | 345/82 |
| 2003/0214476 | A1* | 11/2003 | Matsuda et al. | 345/100 |
| 2004/0257352 | A1 | 12/2004 | Naugler, Jr. et al. | |
| 2004/0257354 | A1 | 12/2004 | Naugler et al. | |
| 2005/0099381 | A1* | 5/2005 | Park | 345/100 |
| 2006/0170634 | A1* | 8/2006 | Kwak et al. | 345/92 |
| 2007/0069998 | A1 | 3/2007 | Naugler, Jr. et al. | |
| 2007/0268210 | A1 | 11/2007 | Uchino et al. | |
| 2008/0074413 | A1* | 3/2008 | Ogura | 345/212 |
| 2008/0186295 | A1* | 8/2008 | Choi | 345/208 |
| 2008/0246697 | A1* | 10/2008 | Kim | 345/76 |

FOREIGN PATENT DOCUMENTS

| | | |
|---|---|---|
| JP | A-63-107380 | 5/1988 |
| JP | A-06-282244 | 10/1994 |
| JP | A-2007-310311 | 11/2007 |
| JP | A-2007-534015 | 11/2007 |
| JP | A-2008-203661 | 9/2008 |

* cited by examiner

*Primary Examiner* — Chanh Nguyen
*Assistant Examiner* — Jonathan Blancha
(74) *Attorney, Agent, or Firm* — Oliff & Berridge, PLC

(57) ABSTRACT

Provided is a method of driving a pixel circuit including a light emitting element and a driving transistor which are connected in series, and a storage capacitor disposed between the path between the light emitting element and the driving transistor and the gate of the driving transistor, the method including the steps of: supplying a driving signal, of which the time rate of change of the potential varies over time, to a gate of the driving transistor; stopping the supply of the driving signal at a point in time which is set to be variable in accordance with a gradation specified for the pixel circuit; and supplying a driving current corresponding to an open circuit voltage of the storage capacitor to the light emitting element.

22 Claims, 17 Drawing Sheets

PIXEL CIRCUIT DRIVING METHOD, LIGHT EMITTING DEVICE, AND ELECTRONIC APPARATUS INCLUDING A VARIABLE DRIVING SIGNAL

This Application claims priority to Japanese Application No. 2008-249809 filed in Japan on Sep. 29, 2008, the disclosure of which is hereby incorporated by reference in its entirety.

BACKGROUND

1. Technical Field

The present invention relates to a technique for driving light emitting elements such as organic electroluminescent (EL) elements.

2. Related Art

In light emitting devices in which a driving current supplied to a light emitting element is controlled by a driving transistor, variations in the electrical characteristics (deviations from target values or variations between elements) of the driving transistor become an issue. JP-A-2007-310311 discloses a technique of setting a gate-source voltage of a driving transistor to the threshold voltage of the driving transistor and then changing the gate-source voltage to a voltage corresponding to a gradation, thereby compensating for the variations (and accordingly, the variation in the amount of the driving current) in the threshold voltage and the mobility of the driving transistor.

However, the effective compensation for the variations in the driving current by the technique disclosed in JP-A-2007-310311 is limited to cases where a specific gradation is specified, and depending on the gradations, in some cases, the variations in the driving current cannot be corrected.

SUMMARY

An advantage of some aspects of the invention is that it provides a technique for suppressing the variations in a driving current with respect to a plurality of gradations.

According to some aspects of the invention, there is provided a method of driving a pixel circuit including a light emitting element and a driving transistor which are connected in series, and a storage capacitor disposed between the path between the light emitting element and the driving transistor and the gate of the driving transistor, the method including the steps of: supplying a driving signal, of which the time rate of change of the potential varies over time, to a gate of the driving transistor; stopping the supply of the driving signal at a point in time which is set to be variable in accordance with a gradation specified for the pixel circuit; and supplying a driving current corresponding to an open circuit voltage of the storage capacitor to the light emitting element.

When the driving signal is supplied to the gate of the driving transistor, a current (a current independent of the threshold voltage or the mobility of the driving transistor), which corresponds to the time rate of change of the potential of the driving signal, flows through the driving transistor. The open circuit voltage of the storage capacitor is set to a voltage capable of allowing the current, which corresponds to the time rate of change of the potential of the driving signal at the point in time when the supply of the driving signal to the gate of the driving transistor stops, to flow through the driving transistor. The time rate of change of the potential of the driving signal varies over time, and the point in time when the supply of the driving signal stops is controlled to be variable in accordance with the gradation of the pixel circuit. Therefore, the time rate of change of the potential at the point in time when the supply of the driving signal stops is set to be variable in accordance with the gradation of the pixel circuit. That is to say, the voltage for allowing the current (the current independent of the threshold voltage or the mobility of the driving transistor), which corresponds to the gradation of the pixel circuit to flow through the driving transistor, is maintained across the storage capacitor. Therefore, the driving current supplied to the light emitting element in response to the open circuit voltage of the storage capacitor is set to a current amount independent of the threshold voltage or the mobility of the driving transistor. Here, the time rate of change of potential refers to the rate of change in potential with the passing of time and has the same meaning as the gradient of potential with respect to a time axis or a time derivative of potential.

According to a preferred aspect of the invention, the driving signal of which the time rate of change of the potential increases over time is supplied to the gate of the driving transistor, and when the first gradation (e.g., the gradation DH in FIG. 6) is specified for the pixel circuit, the supply of the driving signal stops at the later point in time compared to when the second gradation (e.g., the gradation DL in FIG. 6) which is lower than the first gradation is specified. More specifically, for example, it is particularly desirable to employ a configuration where the rate of change of the time rate of change of the potential of the driving signal (namely, the second-order derivative of the potential of the driving signal) increases over time so as to comply with the tendency that the higher the time rate of change of the driving signal, the shorter the period of time for reaching the equilibrium state is required. Moreover, it may be desirable to employ a method of supplying the driving signal of which the time rate of change of the potential decreases over time to the gate of the driving transistor and, when the first gradation is specified for the pixel circuit, stopping the supply of the driving signal at the earlier point in time compared to when the second gradation lower than the first gradation is specified.

Depending on the open circuit voltage of the storage capacitor before the driving signal is supplied, a considerable amount of time may be required for the driving transistor to reach the equilibrium state where the time rate of change of the source potential of the driving transistor becomes identical to the time rate of change of the potential of the gate thereof (namely, the time rate of change of the potential of the driving signal). Therefore, according to a preferred aspect of the invention, the open circuit voltage of the storage capacitor is initialized before the driving signal is supplied.

As a method of initializing the open circuit voltage of the storage capacitor, it may be desirable to employ a method of driving the pixel circuit similar to the case where a high gradation is specified, for example. More specifically, the driving signal is supplied to the gate of the driving transistor and the supply of the driving signal stops at the point in time corresponding to the high gradation, thereby initializing the open circuit voltage of the storage capacitor. A specific embodiment of the above-mentioned aspect will be described in the third embodiment.

Moreover, it may be desirable to employ a method of supplying, prior to supplying the driving signal, a reference potential to the gate of the driving transistor from a signal line for supplying the driving signal and supplying a predetermined potential to the source of the driving transistor, thereby initializing the open circuit voltage of the storage capacitor. In the above-mentioned method, since the signal line for supplying the driving signal is also used for supplying the reference potential, it is possible to provide an advantage that the configuration of the light emitting device can be simplified compared with a configuration where the signal line for supplying the driving signal and the power supply line for supplying the reference potential are individually formed. A specific embodiment of the above-mentioned aspect will be described in the fourth or fifth embodiment, for example.

Moreover, it may be desirable to employ a method of supplying a reference potential to the gate of the driving transistor before supplying the driving signal and controlling the driving transistor to be in the ON state, whereby the open circuit voltage of the storage capacitor is caused to approach a threshold voltage of the driving transistor. In the method of causing the voltage of the storage capacitor to approach the threshold voltage, it is possible to provide an advantage that the period of time required for the driving transistor to be changed to the ON state after the supply of the driving signal starts can be reduced. A specific embodiment of the above-mentioned aspect will be described in the sixth embodiment, for example.

According to a preferred aspect of the invention, there is provided a light emitting device including a pixel circuit including a light emitting element and a driving transistor which are connected in series, a storage capacitor disposed between the path between the light emitting element and the driving transistor and the gate of the driving transistor, and a control switch disposed between the gate of the driving transistor and a signal line; and a driving circuit configured to supply a driving signal, of which the time rate of change of the potential varies over time, to the signal line and supply the driving signal to the gate of the driving transistor by controlling the control switch to be in an ON state, thereby controlling the control switch to be in an OFF state at a point in time which is set to be variable in accordance with a gradation specified for the pixel circuit. According to the above-mentioned aspect, the same operation and the same advantages as those of the driving method according to the invention can be realized.

More specifically, in a configuration where the time rate of change of the potential of the driving signal increases over time, when the first gradation is specified for the pixel circuit, the driving circuit controls the control switch to be in the OFF state at the later point in time compared to when the second gradation lower than the first gradation is specified. On the other hand, in a configuration where the time rate of change of the potential of the driving signal decreases over time, when the first gradation is specified for the pixel circuit, the driving circuit controls the control switch to be in the OFF state at the earlier point in time compared to when the second gradation lower than the first gradation is specified.

According to a preferred aspect of the invention, there is provided a light emitting device including a device portion in which a plurality of pixel circuits is arranged so as to correspond to each intersection of a plurality of scanning lines and a plurality of signal lines, each of the plurality of pixel circuits including a light emitting element and a driving transistor which are connected in series, a storage capacitor disposed between the path between the light emitting element and the driving transistor and the gate of the driving transistor, a control switch disposed between the gate of the driving transistor and the signal line, and a select switch disposed between the gate of the driving transistor and the signal line so as to be conducted during selection of the scanning line; and a driving circuit configured to sequentially select, for every unit time period, each of the plurality of scanning lines so as to supply the driving signal of which the time rate of change of the potential varies over time to the respective signal lines within each of the unit time periods, and control the control switch of each of the respective pixel circuits corresponding to the scanning line to be in an ON state during the unit time period when the scanning line is selected, thereby controlling the control switch to be in an OFF state at a point in time which is set to be variable in accordance with a gradation specified for the pixel circuit. According to the above-mentioned aspect, the same operation and the same advantages as those of the driving method according to the invention can be realized.

The driving circuit according to a preferred aspect of the invention is configured to supply the same driving signal to each of the plurality of signal lines. In the above-mentioned aspect, since the same driving signal is commonly used for setting the driving current in the respective pixel circuits, it is possible to provide an advantage that the operation or the configuration of the light emitting device can be simplified compared with the configuration where a plurality of driving signals is individually generated.

The light emitting device according to a preferred aspect of the invention includes a control line capable of controlling the control switches of two or more pixel circuits corresponding to the signal line, and the control line and the signal line extend in a direction intersecting the extending direction of the scanning lines. According to the above-mentioned aspect, in a light emitting device where the number of pixel circuits corresponding to the scanning lines is greater than the number of pixel circuits corresponding to the signal lines, the load of the control line can be reduced. Therefore, the point in time when the supply of the driving signal stops can be controlled in accordance with the gradation to a high degree of accuracy compared with the configuration where the control lines extend in the same direction as the scanning lines.

According to a preferred aspect of the invention, during two or more unit time periods before the start of a unit time period for selecting one scanning line among the plurality of scanning lines, the driving circuit supplies a reference potential from a power supply line to the gate of each of the driving transistors of the respective pixel circuits corresponding to the one scanning line and controls the driving transistors to be in an ON state, thereby causing the open circuit voltage of the storage capacitor to approach a threshold voltage of each of the driving transistors. In the above-mentioned aspect, the open circuit voltage of the storage capacitor is caused to approach the threshold voltage of the driving transistor before the driving signal is supplied to the pixel circuit. Therefore, it is possible to reduce the period of time required for the driving transistor to be changed to the ON state after the supply of the driving signal starts (and accordingly, the period of time required for the time rate of change of the potential of the source of the driving transistor to reach the time rate of change of the driving signal).

The light emitting device according to the invention is used in various electronic apparatuses. A typical example of the electronic apparatus is an apparatus that uses the light emitting device as a display device. An example of the electronic apparatus according to the invention includes a personal computer and a cellular phone. The application of the light emitting device according to the invention is not limited to displaying of an image. For example, the light emitting device according to the invention may be applied to an exposure device (optical head) for forming latent images on an image carrier such as a photosensitive drum by irradiation of light beams.

BRIEF DESCRIPTION OF THE DRAWINGS

The invention will be described with reference to the accompanying drawings, wherein like numbers reference like elements.

DETAILED DESCRIPTION OF EMBODIMENTS

A: Driving Principle

Figure 1:
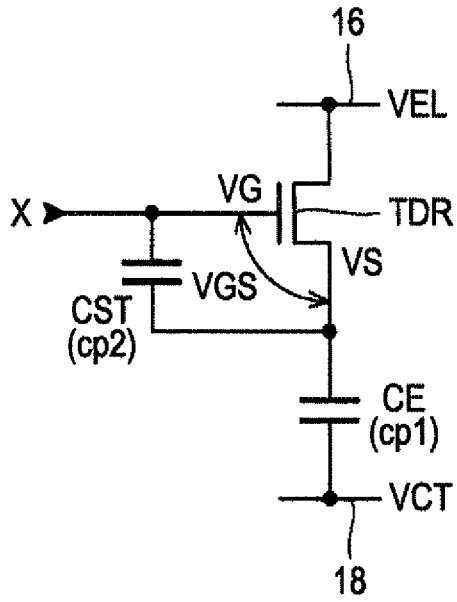
FIG. 1 is a circuit diagram for explaining the driving principle of a pixel circuit.

The principle used in driving the pixel circuit in each embodiment will be described prior to description of specific embodiments of the invention. As illustrated in FIG. 1, a circuit will be considered in which an N-channel driving transistor TDR and a capacitor CE (with capacitance cp1) are arranged in series on a path connecting a power supply line 16 and a power supply line 18.

The power supply line 16 is supplied with a potential VEL, and the power supply line 18 is supplied with a potential VCT (VCT<VEL). The drain of the driving transistor TDR is connected to the power supply line 16, and the capacitor CE is disposed between the source of the driving transistor TDR and the power supply line 18. A storage capacitor CST (with capacitance cp2) is disposed between the gate and the source of the driving transistor TDR. A voltage VGS (VGS=VG−VS) which is the difference between the gate potential VG and the source potential VS of the driving transistor TDR is applied between opposite ends of the storage capacitor CST.

Figure 2:
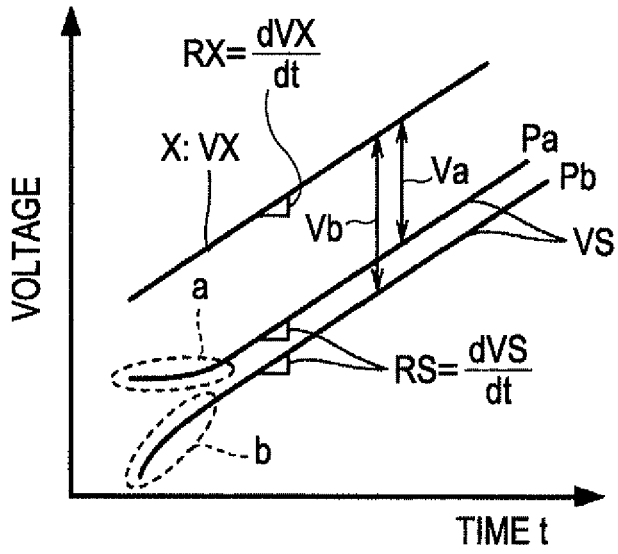
FIG. 2 is a graph for explaining the driving principle of the pixel circuit.

The gate of the driving transistor TDR is supplied with a driving signal X. The driving signal X is a voltage signal of which the potential VX rises over time as illustrated in FIG. 2. FIG. 2 illustrates a case where the time rate of change RX (RX=dVX/dt) of the potential VX is a constant (namely, the time rate of change rises linearly). In FIG. 2, the change over time of the source potential VS is written down with respect to each case of Pa and Pb which are the electrical characteristics (the mobility or the threshold voltage) of the driving transistor TDR.

When the gate potential VG (at potential VX) of the driving transistor TDR rises with the supply of the driving signal X, so that the gate-source voltage VGS of the driving transistor TDR becomes higher than the threshold voltage VTH of the driving transistor TDR, a current IDS begins to flow between the drain and the source of the driving transistor TDR. The current IDS is expressed by Equation 1 below. In Equation 1, μ is the mobility of the driving transistor TDR. Moreover, W/L is the ratio of the channel width W relative to the channel length L of the driving transistor TDR, and Cox is the capacitance per unit area of the gate insulation film of the driving transistor TDR.

$$IDS = \tfrac{1}{2} \cdot \mu \cdot W/L \cdot Cox \cdot (VGS - VTH)^2 \qquad \text{Equation 1}$$

On the other hand, since the capacitor CE and the storage capacitor CST are charged with electric charges when the current IDS begins to flow through the driving transistor TDR, the source potential VS of the driving transistor TDR varies over time with the time rate of change RS (RS=dVS/dt) as illustrated in FIG. 2. The relationship of Equation 2 below is satisfied between the current IDS and the source potential VS of the driving transistor TDR.

$$\begin{aligned} IDS &= dQ/dt \qquad \text{Equation 2} \\ &= cp2 \cdot (dVS/dt - dVX/dt) + cp1 \cdot dVS/dt \end{aligned}$$

In the case of the "a" portion in FIG. 2, where the time rate of change (i.e., the gradient of the potential VS with respect to the time t) RS of the source potential VS of the driving transistor TDR is lower than the time rate of change RX of the potential VX of the driving signal X, the gate-source voltage VGS of the driving transistor TDR increases over time. As is clear from Equation 1, the current IDS increases as the voltage VGS increases. In addition, as can be understood from Equation 2, the time rate of change RS also increases as the current IDS increases. That is to say, the time rate of change RS increases when the time rate of change RS is lower than the time rate of change RX.

On the other hand, in the case of the "b" portion in FIG. 2, where the time rate of change RX of the potential VX of the driving signal X is lower than the time rate of change RS of the source potential VS, the gate-source voltage VGS decreases over time. Therefore, as can be understood from Equation 1, the current IDS decreases. When the current IDS decreases, the time rate of change RS decreases. That is to say, the time rate of change RS decreases when the time rate of change RS exceeds the time rate of change RX.

As described above, the time rate of change RS of the source potential VS of the driving transistor TDR approaches, over time, the time rate of change RX of the potential VX of the driving signal X and finally reaches the time rate of change RX, independent of the characteristic of the driving transistor TDR (i.e., in any of the cases involving characteristics Pa and Pb). The state (hereinafter, referred to as "equilibrium state") where the time rate of change RS is identical to the time rate of change RX can be expressed also as a state where an increase in the voltage VGS due to an increase in the potential VX of the driving signal X and a decrease in the voltage VGS due to charging with the current IDS are balanced.

In the equilibrium state, since the time rate of change RS and the time rate of change RX are identical (RS=dVS/dt=RX=dVX/dt), Equation 2 can be changed to Equation 3 below. That is to say, the current IDS flowing through the driving transistor TDR is proportional to the time rate of change RX of the potential VX of the driving signal X. More specifically, the current IDS is determined only by the capacitance cp1 of the capacitor CE and the time rate of change RX of the potential VX, but does not depend on the mobility μ or the threshold voltage VTH of the driving transistor TDR.

$$\begin{aligned} IDS &= cp2\cdot(dVS/dt - dVX/dt) + cp1\cdot dVS/dt \\ &= cp2\cdot(dVX/dt - dVX/dt) + cp1\cdot dVX/dt \\ &= cp1\cdot RX \end{aligned} \qquad \text{Equation 3}$$

The gate-source voltage VGS of the driving transistor TDR is automatically set to a voltage (i.e., the voltage VGS satisfying the relationship of Equation 1 with respect to the current IDS given by Equation 3) required to cause the current IDS to flow given by Equation 3, which is independent of the mobility μ or the threshold voltage VTH to the driving transistor TDR, in accordance with its mobility μ or threshold voltage VTH. For example, the voltage VGS is set to a voltage Va when the driving transistor TDR has the characteristic Pa in FIG. 2, while the voltage VGS is set to a voltage Vb when the driving transistor TDR has the characteristic Pb in FIG. 2. During the equilibrium state, in any of the cases with characteristics Pa and Pb, the same current IDS which depends only on the capacitance cp1 and the time rate of change RX flows through the driving transistor TDR.

The gate-source voltage VGS which is set in the above-described manner is stored in the storage capacitor CST, whereby the current IDS can continue to flow through the driving transistor TDR even after the supply of the driving signal X (at potential VX) stops. In the embodiments described below, the current IDS is used as a current (hereinafter, referred to as "driving current") IDR for driving a light emitting element. As described above with reference to Equation 3, since the current IDS does not depend on the characteristics (mobility μ or threshold voltage VTH) of the driving transistor TDR, it is possible to compensate for the variations (and the luminance variations of the light emitting element) in the driving current IDR due to the characteristic variations of the driving transistor TDR. On the other hand, since the driving current IDR (current IDS) is determined by the time rate of change RX of the potential VX of the driving signal X, it is possible to set the current amount (and the luminance of the light emitting element) of the driving current IDR to be variable by controlling the time rate of change RX of the driving signal X.

B: First Embodiment

B-1: Configuration and Operation of Light Emitting Device

Figure 3:
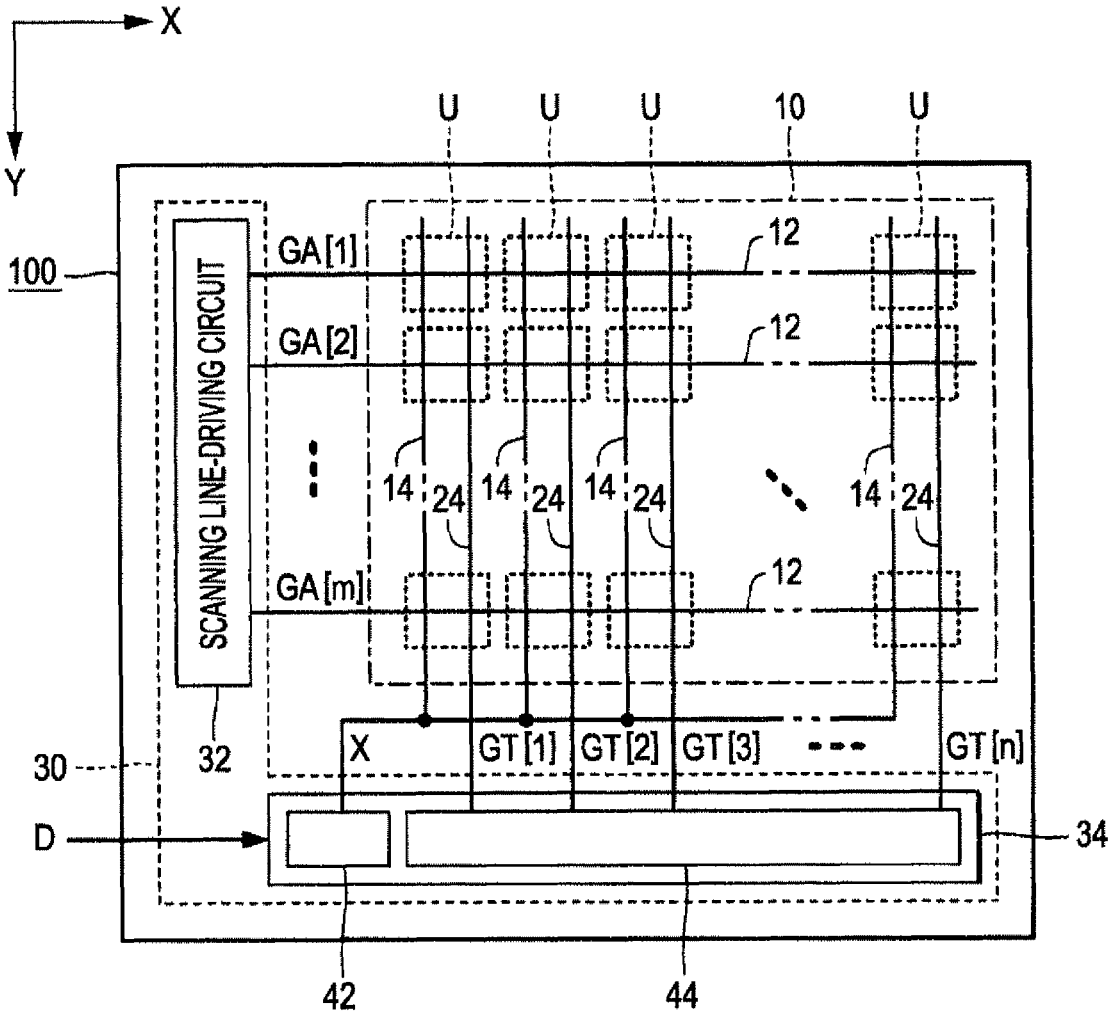
FIG. 3 is a block diagram of a light emitting device according to a first embodiment of the invention.

FIG. 3 is a block diagram of a light emitting device according to a first embodiment of the invention. The light emitting device 100 is mounted on an electronic apparatus as a display device displaying images. As illustrated in FIG. 3, the light emitting device 100 includes a device portion 10 on which a plurality of pixel circuits U is arranged, and a driving circuit 30 for driving the pixel circuits U. The driving circuit 30 is configured to include a scanning line-driving circuit 32 and a signal line-driving circuit 34. The driving circuit 30 is implemented on a plurality of distributed integrated circuits, for example. It should be noted that at least a part of the driving circuit 30 may be constructed of thin film transistors which are formed on a substrate, together with the pixel circuits U.

In the device portion 10, m scanning lines 12 extending in the X direction and n signal lines 14 extending in the Y direction so as to intersect the X direction are formed (where, m and n are natural numbers). The plurality of pixel circuits U is disposed at intersections of the respective scanning lines 12 and the respective signal lines 14 and arranged in a matrix form having m rows in the vertical direction and n columns in the horizontal direction. Moreover, n control lines 24 extending in the Y direction in parallel to the respective signal lines 14 are also formed in the device portion 10.

The scanning line-driving circuit 32 is configured to output scanning signals GA[1] to GA[m] to the respective scanning lines 12. The signal line-driving circuit 34 is configured to include a signal generation circuit 42 and a gradation control circuit 44. The signal generation circuit 42 is configured to output the driving signal X commonly to the n signal lines 14. The gradation control circuit 44 is configured to output control signals GT[1] to GT[n] corresponding to the gradation D of each of the pixel circuits U to the respective control lines 24. It should be noted that the signal generation circuit 42 and the gradation control circuit 44 may be implemented as independent integrated circuits, respectively.

Figure 4:
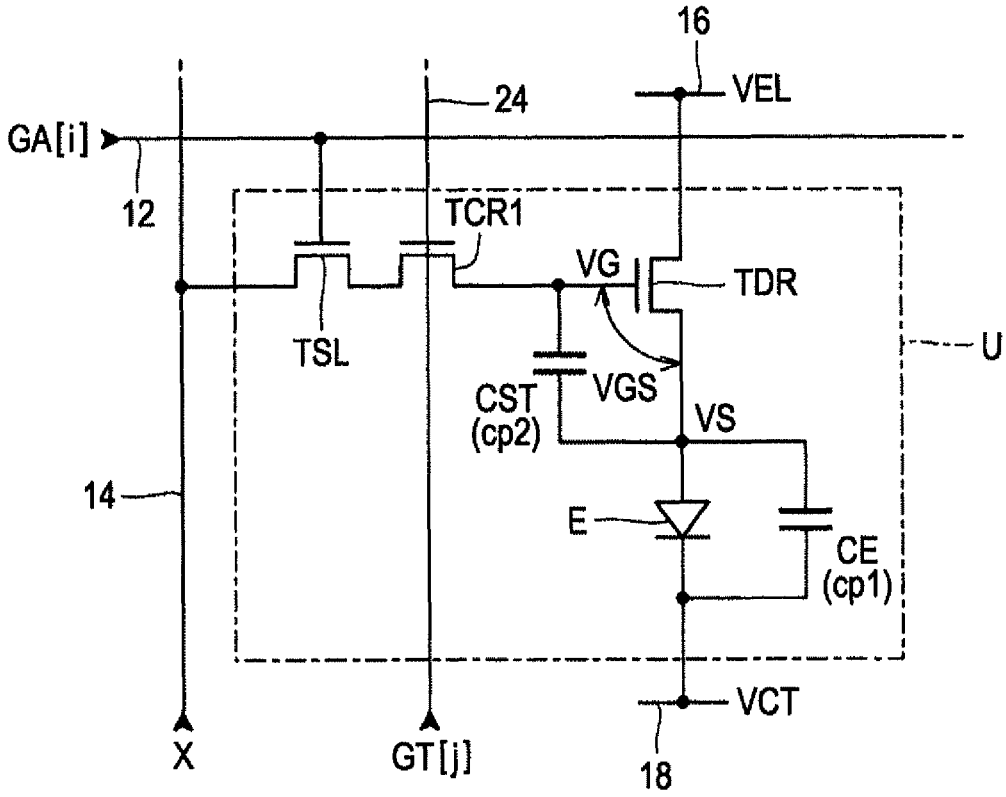
FIG. 4 is a circuit diagram of a pixel circuit.

FIG. 4 is a circuit diagram of the pixel circuit U. In FIG. 4, only one pixel circuit U disposed on the i-th row (i=1 to m) and j-th column (j=1 to n) is illustrated as a representative. As illustrated in FIG. 4, the pixel circuit U is configured to include a light emitting element E, a driving transistor TDR, a storage capacitor CST, a select switch TSL, and a control switch TCR1. The select switch TSL and the control switch TCR1 are N-channel transistors (e.g., thin-film transistors), for example.

The light emitting element E and the driving transistor TDR are arranged in series on a path that connects a power supply line 16 (at potential VEL) and a power supply line 18 (at potential VCT). The light emitting element E is an organic EL element in which a light emitting layer formed of an organic electroluminescent (EL) material is sandwiched between its opposite terminals, namely, the anode and cathode thereof. As depicted in FIG. 4, the capacitor CE (with capacitance cp1) shown in FIG. 1 is associated with the light emitting element E.

The driving transistor TDR is an N-channel transistor (for example, a thin-film transistor) having a drain thereof being connected to the power supply line 16 while a source thereof is connected to the anode of the light emitting element E. The storage capacitor CST (with capacitance cp2) is disposed between the source (the path between the light emitting element E and the driving transistor TDR) of the driving transistor TDR and the gate of the driving transistor TDR.

The select switch TSL and the control switch TCR1 are disposed to be connected in series between the signal line 14 and the gate of the driving transistor TDR to control the electrical connection (conduction/non-conduction) between the signal line 14 and the gate of the driving transistor TDR. Specifically, when both the select switch TSL and the control switch TCR1 are controlled to be in the ON state, the gate of the driving transistor TDR is electrically connected to the signal line 14. The gates of the select switches TSL of each of the n pixel circuits U disposed on the i-th row are commonly connected to the scanning lines 12 on the i-th row, and the gates of the control switches TCR1 of each of the m pixel circuits U on the j-th column are commonly connected to the control lines 24 on the j-th column. Although FIG. 2 illustrates the arrangement in which the select switch TSL is disposed between the signal line 14 and the control switch TCR1, an arrangement may be in which the control switch TCR1 is disposed between the signal line 14 and the select switch TSL.

Figure 5:
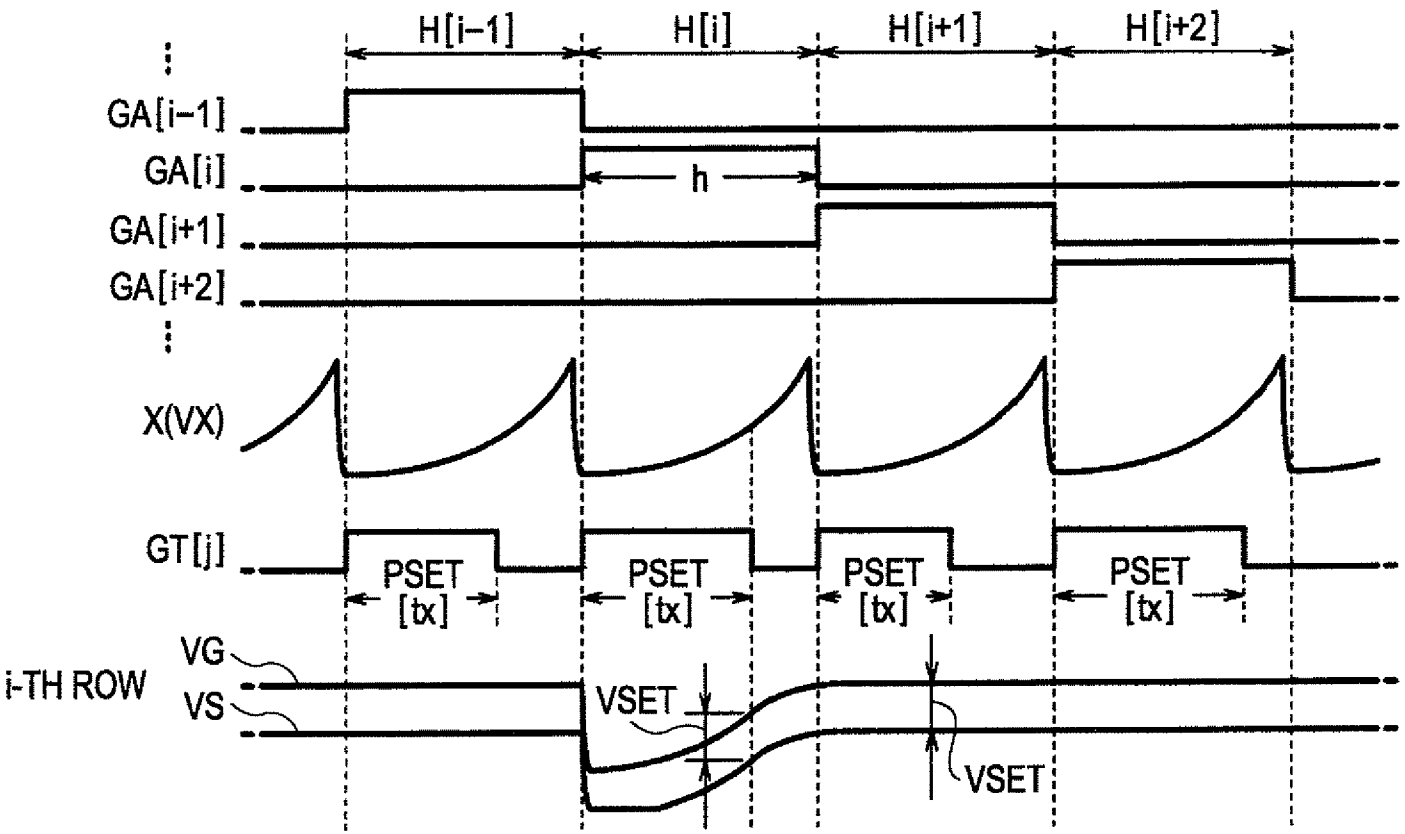
FIG. 5 is a timing chart illustrating the operation of the light emitting device.

Next, with reference to FIG. 5, the operation (the method of driving the pixel circuit U) of the driving circuit 30 will be described with particular attention to the pixel circuit U disposed on the i-th row and the j-th column. The scanning line-driving circuit 32 sequentially sets the scanning signals GA[1] to GA [m] to an active level (High level) in each of m unit time periods H (H[1] to H[m]) within a vertical scanning period, thereby sequentially selecting the respective scanning lines 12 (a group of n pixel circuits U on each row). As illustrated in FIG. 5, the scanning signal GA[i] is set to the active level (High level which means the selection of the scanning line 12) during the i-th unit time period H[i] within the vertical scanning period, and during other periods than the unit time period H[i], maintains a non-active level (Low level). When the scanning signal GA[i] transitions to the active level, the select switches TSL of each of the n pixel circuits U on the i-th row are simultaneously changed to an ON state.

Figure 6:
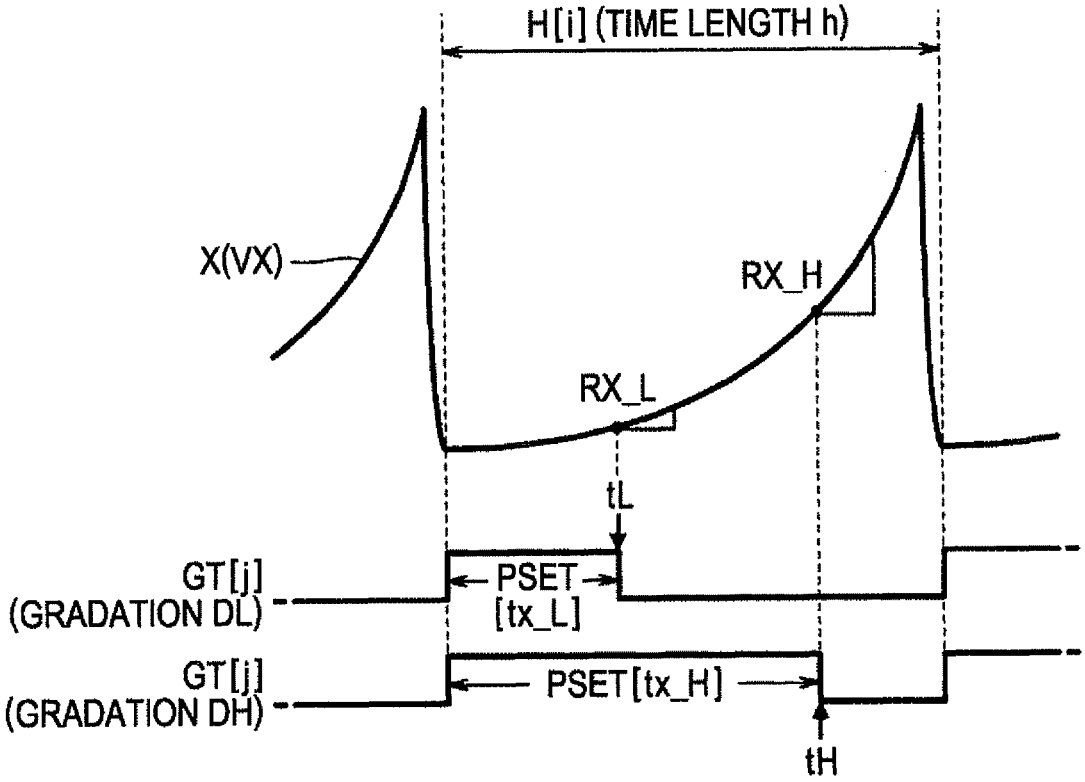
FIG. 6 is a conceptual diagram for explaining the relationship between the length of time of a gradation setting period and a gradation.

The signal generation circuit 42 of the signal line-driving circuit 34 generates a driving signal X of which the potential VX varies over time with a period of the unit time period H. As illustrated in FIGS. 5 and 6, the potential VX of the driving signal X varies (rises) continuously from the starting point to the end point of the respective unit time periods H. The time rate of change RX (RX=dVX/dt) of the potential VX is set to zero at the starting point of the respective unit time periods H and rises over time within each unit time period H. For example, as illustrated in FIG. 6, the time rate of change RX_H at the point in time tH on the time axis is higher than the time rate of change RX_L at the point in time tL earlier than the point in time tH. Therefore, the potential waveform within each unit time period H of the driving signal X assumes a downwardly convex curve (a waveform similar to a ramp wave).

As illustrated in FIG. 5, the gradation control circuit 44 shown in FIG. 3 controls the control signal GT[j] output to the control lines 24 on the j-th column to be set to the active level (High level) during a gradation setting period PSET within each unit time period H while controlling the control signal GT[j] to be set to the non-active level (Low level) during the remaining periods of the unit time period H. The gradation setting period PSET is a period of time having a length of tx which starts from the starting point of the unit time period H.

The time length tx of the gradation setting period PSET (namely, the pulse width of the control signal GT[j]) is set to be variable within a predetermined range (for example, a range from zero to the time length h of the unit time period H) in accordance with the specified gradation D of the pixel circuit U. Specifically, the time length tx of the gradation setting period PSET during which the scanning lines 12 on the i-th row are selected and the control signal GT[j] is set to the active level within the unit time period H[i] is set to be variable in accordance with the gradation D of the pixel circuit U disposed on the i-th row and the j-th column. More specifically, the higher the specified gradation D of the pixel circuit U (the larger the driving current IDR to be supplied to the light emitting element E), the longer the set time length tx of the gradation setting period PSET within the respective unit time periods H becomes.

As illustrated in FIG. 6, the time length tx_H of the gradation setting period PSET when the gradation DH is specified for the pixel circuit U is longer than the time length tx_L of the gradation setting period PSET when the gradation DL lower than the gradation DH is specified. In other words, the point in time at which the control signal GT[j] within the unit time period H[i] starts to fall (namely, the end point of the gradation setting period PSET) is controlled in accordance with the gradation D of the pixel circuit U on the i-th row and the j-th column. Since the time rate of change RX of the potential VX of the driving signal X varies over time, the time rate of change RX at the end point of the gradation setting period PSET varies in accordance with the gradation D. For example, as illustrated in FIG. 6, the time rate of change RX_H at the end point tH of the gradation setting period PSET when the gradation DH is specified is higher than the time rate of change RX_L at the end point tL of the gradation setting period PSET when the gradation DL is specified.

Since the select switches TSL of the respective pixel circuits U on the i-th row are set to be in the ON state during the unit time periods H[i], when the control signal GT[i] transitions to the active level, so that the control switches TCR1 are changed to the ON state, the gates of the driving transistors TDR are electrically connected to the signal line 14. As a result, as described above with reference to FIG. 1, the gate of the driving transistor TDR is supplied with the driving signal X, and as shown in FIG. 5, the potential VG of the gate rises over time with the time rate of change RX of the potential VX of the driving signal X. On the other hand, the current IDS corresponding to a variation in the potential VG flows between the drain and the source of the driving transistor TDR, and thus, the source potential VS rises over time. Moreover, when the time rate of change RS (RS=dVS/dt) of the potential VS reaches an equilibrium state where it becomes identical to the time rate of change RX (RX=dVX/dt) of the potential VX of the driving signal X, the current IDS which depends only on the capacitance cp1 of the capacitor CE and the time rate of change RX flows through the driving transistor TDR. Since the driving signal X is generated so that the time rate of change RX increases over time, the current amount of the current IDS increases over time during the gradation setting period PSET.

When the time length tx has passed from the starting point of the unit time period H[i] (namely, the starting point of the gradation setting period PSET) and the control signal GT[j] drops to the non-active level, the control switch TCR1 is changed to the OFF state, so that the supply of the driving signal X to the gate of the driving transistor TDR stops. As illustrated in FIG. 5, the storage capacitor CST maintains therein a voltage VSET corresponding to the current IDS flowing through the driving transistor TDR at the point in time when the supply of the driving signal X stops. That is to say, the voltage VSET is a gate-source voltage VGS required to cause the current IDS to flow through the driving transistor TDR, the current IDS being determined by the capacitance cp1 of the capacitor CE and the time rate of change RX (in other words, independent of the mobility μ or the threshold voltage VTH of the driving transistor TDR).

Since the voltage VSET is stored in the storage capacitor CST, the current IDS is able to flow between the drain and the source of the driving transistor TDR even after the supply of the driving signal X stops. Therefore, the source potential VS of the driving transistor TDR rises over time. On the other hand, when the control switch TCR1 transitions to the OFF state, the gate of the driving transistor TDR is held in an electrically floating state. Therefore, as illustrated in FIG. 5, the gate potential VG of the driving transistor TDR rises with the potential of the source potential VS. That is to say, while the gate-source voltage VGS of the driving transistor TDR maintains the voltage VSET at the end point of the gradation setting period PSET, the open circuit voltage (the source potential VS of the driving transistor TDR) of the capacitor CE increases gradually. When the open circuit voltage of the capacitor CE reaches the threshold voltage VTH_OLED of the light emitting element E, the current IDS corresponding to the voltage VSET flows as the driving current IDR through the light emitting element E. The light emitting element E is lighted with the luminance (specified gradation D) corresponding to the current amount of the driving current IDR.

The driving current IDR (the current IDS) is set to have approximately the same current amount as the current IDS flowing through the driving transistor TDR at the point in time when the supply of the driving signal X stops. That is to say, the driving current IDR depends on the time rate of change RX at the point in time when the supply of the driving signal X stops. As described with reference to FIG. 6, since the time rate of change RX at the point in time when the supply of the driving signal X stops is set to be variable in accordance with the gradation D, the light emitting element E is supplied with the driving current IDR corresponding to the gradation D. For example, as illustrated in FIG. 6, since the time rate of change RX_H at the point in time tH when the gradation DH is specified is higher than the time rate of change RX_L at the point in time tL when the gradation DL (DL<DH) is specified, the current amount of the driving current IDR when the gradation DH is specified is larger than the current amount of the driving current IDR when the gradation DL is specified. As described above, the light emitting element E of each of the respective pixel circuits U is controlled to have the luminance corresponding to the gradation D.

In the above-described embodiment, the open circuit voltage VSET of the storage capacitor CST is set so that the current IDS (current being independent of the mobility μ or the threshold voltage VTH of the driving transistor TDR) corresponding to the time rate of change RX of the potential VX of the driving signal X flows through the driving transistor TDR. Therefore, it is possible to suppress the variations (and accordingly, the luminance variations of the light emitting element E) in the driving current IDR due to the characteristics (the mobility μ or the threshold voltage VTH) of the driving transistor TDR, independently of the specified gradation D of each of the pixel circuits U. As a result, it is possible to provide an advantage that the variations in gradation of images displayed on the device portion 10, for example, can be suppressed.

As an example of the configuration where the time rate of change RX of the driving signal X to be used for determining the driving current IDR is changed in accordance with the gradation D, a configuration (hereinafter, referred to as "comparative example") where the driving signal X of which the time rate of change RX is set in accordance with the gradation D of each of the respective pixel circuits U is individually supplied to the respective pixel circuits U may be considered. In the present embodiment, since the time rate of change RX of the driving signal X is varied over time, and moreover, the point in time when the supply of the driving signal X stops is controlled in accordance with the gradation D, it is possible to provide an advantage that the driving signal X can be commonly used for a plurality of pixel circuits U, compared with the comparative example. Moreover, since the control of the point in time when the supply of the driving signal X stops (namely, the control of the pulse width of the control signal GT[j]) is easier than the control of the time rate of change RX of the respective driving signal X, it is possible to provide an advantage that the operation or the configuration of the signal line-driving circuit 34 can be simplified compared with the comparative example.

However, since the waveform distortion of the control signal GT[j] becomes obvious when the load (the number of pixel circuits U) associated with the control line 24 for supplying the control signal GT[j] is large, the point in time when the supply of the driving signal X to the respective pixel circuits U stops (and accordingly, the time rate of change RX used for determining the driving current IDR) becomes difficult to be controlled with high accuracy. On the other hand, for example, in a configuration where the pixel circuits U corresponding a plurality of display colors (e.g., red, green, and blue) are arranged in the X direction, the number of columns n of the pixel circuits U in the device portion 10 (namely, the total number of signal lines 14 or control lines 24) is often larger than the number of rows m (the total number of scanning lines 12). In the present embodiment where the control lines 24 extend in the Y direction in parallel to the signal lines 14, since the number m of pixel circuits U becoming the load of one control line 24 is smaller than the number n of pixel circuits U on one row, the load of the control lines 24 can be reduced compared with a configuration where one control line 24 is commonly used for n pixel circuits U which are arranged in the X direction, for example. Therefore, it is possible to provide an advantage that the distortion of the waveform of the control signal GT[j] can be suppressed and the point in time at which the supply of the driving signal X stops (and accordingly, the time rate of change RX used for determining the driving current IDR) can be controlled with high accuracy.

Moreover, since the signal lines 14 through which the driving signal X is supplied extend in the Y direction, when the number of columns n of the pixel circuits U in the device portion 10 is larger than the number of rows m, for example, the load of the respective signal lines 14 can be reduced compared with a configuration where the signal line 14 on each row extends in the X direction. Therefore, it is possible to suppress the waveform distortion of the driving signals X transmitted through the respective signal lines 14. In other words, it is possible to provide an advantage that the driving signal X, of which the time rate of change RX for determining the driving current IDR is set with high accuracy, can be transmitted. It should be noted that the configuration where the signal lines 14 extend in the Y direction is not essential. For example, a configuration where the signal lines 14 extend in the X direction or a configuration where the signal lines 14 are formed in a grid form (mesh form) in both the X and Y directions may be employed.

B-2: Determination of Waveform of Driving Signal X

Next, a method of determining the waveform (the waveform in the unit time period H) of the driving signal X will be described in detail.

Figure 7A:
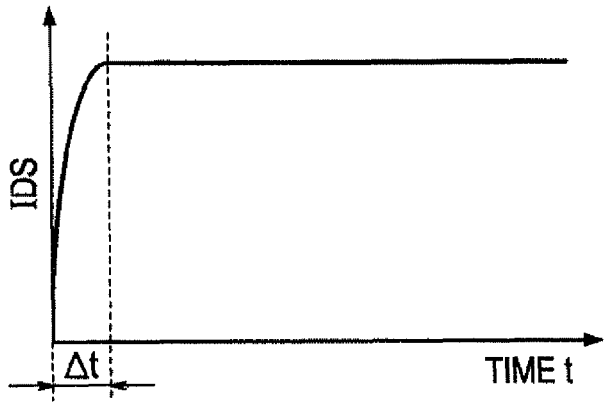
FIGS. 7A and 7B are graphs for explaining the length of time taken to reach an equilibrium state when the voltage gradient of a control signal is high.
Figure 7B:
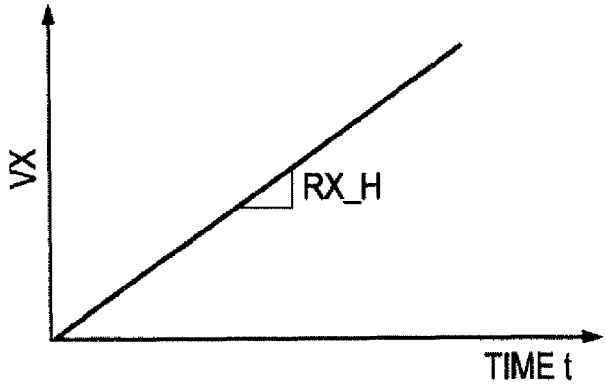
Figure 8A:
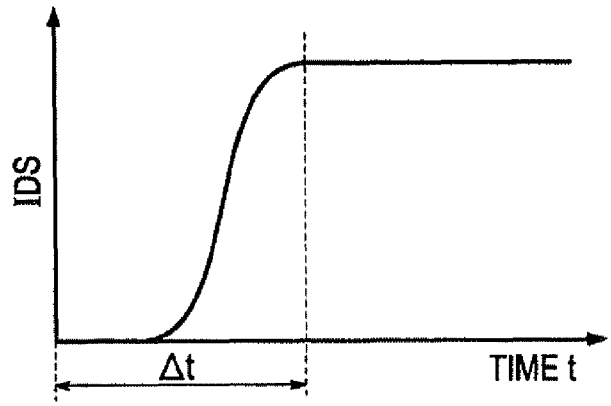
FIGS. 8A and 8B are graphs for explaining the length of time taken to reach an equilibrium state when the voltage gradient of the control signal is low.
Figure 8B:
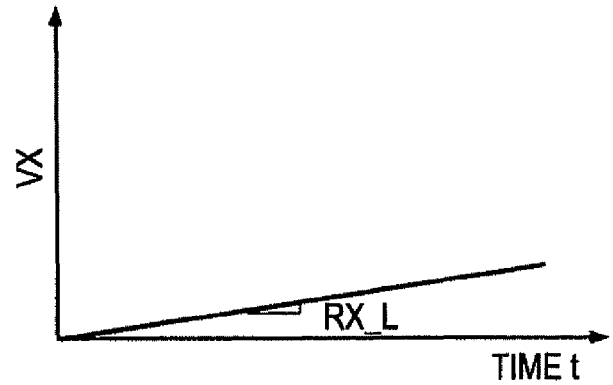

FIGS. 7 and 8 are graphs illustrating the correlation between the time rate of change RX of the potential VX of the driving signal X and the drain-source current IDS of the driving transistor TDR. FIGS. 7A and 7B depict the change over time of the current IDS when the potential VX was changed with the time rate of change RX (RX_H) corresponding to the high gradation DH. On the other hand, FIGS. 8A and 8B depict the change over time of the current IDS when the potential VX was changed with the time rate of change RX (RX_L) corresponding to the low gradation DL (namely, when the potential VX was changed smoothly). In any of FIGS. 7 and 8, the gate-source voltage VGS of the driving transistor TDR was set to a voltage close to the threshold voltage VTH at the point in time (the left end of the graph) at which the potential VX begins to change. Therefore, the current IDS is zero at the point in time at which the potential VX begins to change.

As can be understood from Equation 3, the current amount of the current IDS is stabilized into a predetermined value corresponding to the time rate of change RX of the driving signal X when the source potential VS of the driving transistor TDR reaches the equilibrium state after the change of the potential VX of the driving signal X is begun. When the graphs in FIGS. 7A and 8A are compared, it is possible to identify the tendency that the lower the time rate of change RX, the longer the period of time Dt is required to reach the equilibrium state.

Considering the above-mentioned tendency, it can be understood that it is preferable to determine the waveform of the driving signal X so that the time rate of change RX is changed smoothly for the lower values of the time rate of change RX while the time rate of change RX is changed abruptly for the higher values of the time rate of change RX. In other words, a waveform of which the time derivative of the time rate of change RX (namely, the second-order derivative of the potential VX) increases over time is preferable. This is because of the following reasons. If the time rate of change RX is changed smoothly for the higher values of the time rate of change RX, it is necessary to secure a longer period of time (the length of the unit time period H) for varying the potential VX regardless of whether the source potential VS of the driving transistor TDR has sufficiently reached the equilibrium state. If the time rate of change RX is changed abruptly for the lower values of the time rate of change RX, the potential VS of the source of the driving transistor TDR will not reach the equilibrium state sufficiently (and accordingly, the deviation in the driving current IDR cannot be effectively corrected).

In consideration of the above discussion, the potential VX of the driving signal X is defined by Equation 4 below. The constant α in Equation 4 is chosen so that the time rate of change RX (derivative) of the potential VX at the end point (t=h) of the unit time period H becomes a predetermined value (Imax/cp1) which is independent of the order n, as described in Equation 5 below, for example. Moreover, Imax in Equation 5 is the maximum value of the current amount of the driving current IDR.

$$VX=a\cdot t^{n} \qquad \text{Equation 4}$$

$$\alpha\cdot n\cdot h^{n-1}=\mathrm{Imax}/cp1 \qquad \text{Equation 5}$$

Figure 9:
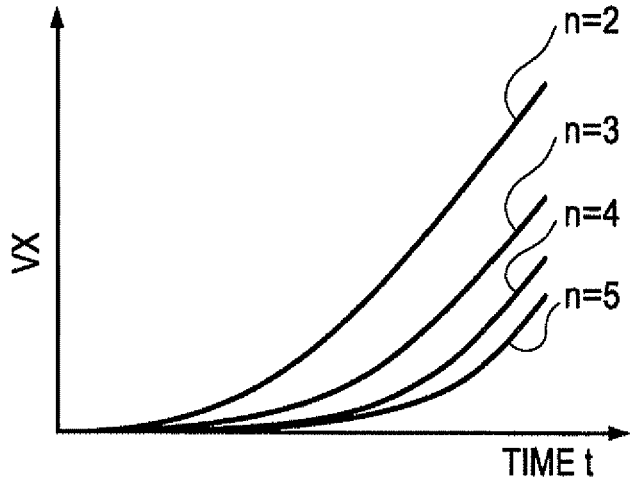
FIG. 9 is a graph showing the waveform of the control signal for each order of a definitional equation thereof.

FIG. 9 is a graph illustrating the change over time of the potential VX (namely, the waveform of the driving signal X) for each of a plurality of orders n (n=2 to 5) of the time t in Equation 4. As illustrated in FIG. 9, the potential VX of the driving signal x within the unit time period H decreases as the order n increases. Therefore, from the viewpoint of decreasing the amplitude of the driving signal X (namely, decreasing the voltage withstanding properties required for the signal line-driving circuit 34), it is preferable that the order n of Equation 4 has a large value. Moreover, since the time rate of increase in the derivative of the time rate of change RX increases as the order n increases, it is preferable that the order n of Equation 4 has a large value even when the results of the discussion in FIGS. 7 and 8 are considered.

Figure 10:
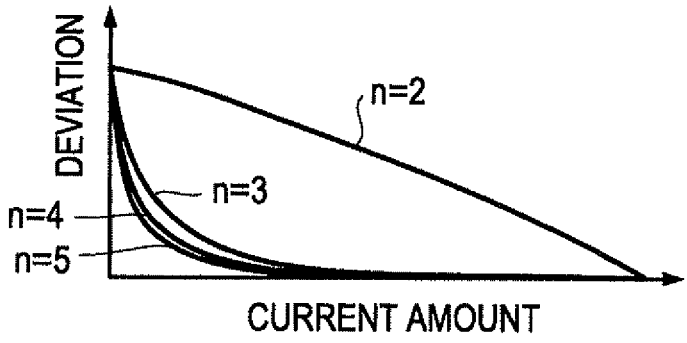
FIG. 10 is a graph showing the deviation in a driving current for each order of the definitional equation of the control signal.

FIG. 10 is a graph illustrating the correlation between the target value of the current amount of the driving current IDR and a deviation for each of the plurality of orders n (n=2 to 5). The deviation on the vertical axis of FIG. 10 is a relative ratio (in absolute value) of the maximum value and the minimum value of the current amount of the driving current IDR which is actually supplied to the light emitting element E when the pixel circuit U was driven so that the current amount of the driving current IDR corresponds to the respective target values (on the horizontal axis).

It can be understood from FIG. 10 that the deviation in the driving current IDR was effectively reduced when the order n of Equation 4 was set to 3 or higher. As illustrated in FIG. 10, when the order n was set to 2, the deviation in the driving current IDR increased greatly compared with when the order n was set to 3 or higher. Considering the fact that the second-order derivative of the potential VX for the order n of 3 or higher increases over time whereas the second-order derivative of the potential VX for the order n of 2 has a fixed value, the results illustrated in FIG. 10 are consistent with the results of the discussion in FIGS. 7 and 8 that it is preferable to have a waveform in which the second-order derivative of the potential VX increases over time. Therefore, it is preferable that the order n of the time t of the function defining the potential VX is 3 or higher.

On the other hand, it was confirmed that the deviation in the driving current IDR when an intermediate gradation was specified increased as the order n was increased to 5 and higher. Therefore, it is preferable to have the driving signal X in which the order n is set to 5 or lower. As described above, when the potential VX is defined by Equation 4, it is preferable to set the order n of the time t to be in the range of 3 to 5, and particularly preferably, the order n is set to 5.

However, Equation 4 is a mere example of the waveform of the potential of the driving signal X. That is to say, the waveform of the potential of the driving signal X may be appropriately modified on condition that the time rate of change RX of the potential VX varies over time. For example, the potential VX may be defined by Equation 6 below. In Equation 6, the number e is the base of the natural logarithm, and the constant β is chosen so that the time rate of change RX of the potential VX at the end point (t=h) of the unit time period H becomes a predetermined value (e.g., Imax/cp1).

$$VX=\mathrm{beta}\cdot^{en\cdot t} \qquad \text{Equation 6}$$

B-3: Specific Configuration of Signal Line-Driving Circuit 34

Figure 11:
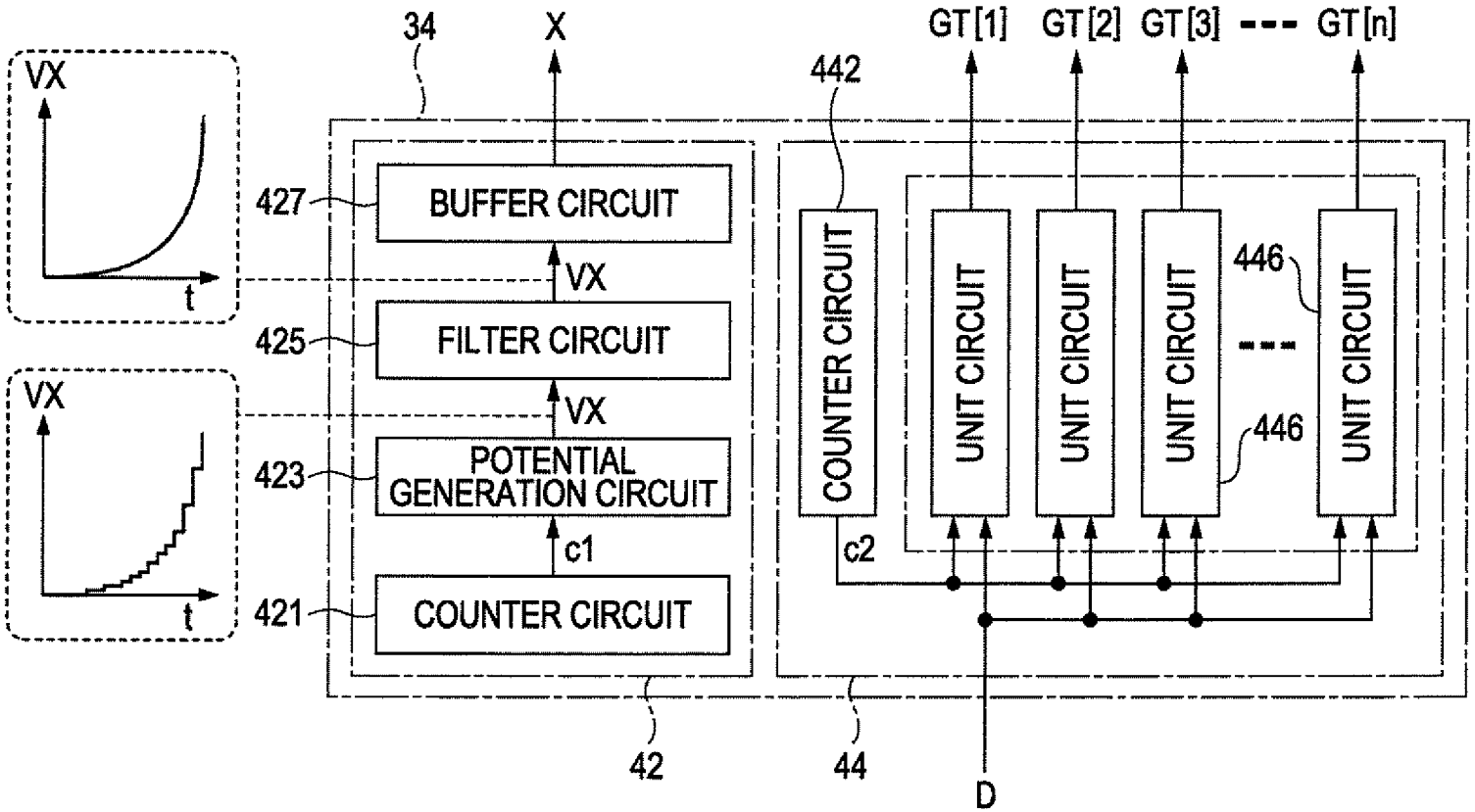
FIG. 11 is a circuit diagram of a signal line-driving circuit.

A specific example of the configuration of the signal line-driving circuit 34 will be described with reference to FIG. 11. As illustrated in FIG. 11, the signal generation circuit 42 is configured to include a counter circuit 421, a potential generation circuit 423, a filter circuit 425, and a buffer circuit 427. The counter circuit 421 is configured to count a predetermined clock signal and initializes a counted value c1 to zero at the starting point of each of the respective unit time periods H. The counted value c1 corresponds to the period of time t elapsed after the start of the unit time period H. The potential generation circuit 423 is configured to output a potential VX corresponding to the counted value c1 from the counter circuit 421. The counted value c1 (time t) and the potential VX are chosen to have such a relationship that the time rate of change RX of the potential VX increases over time (in other words, the relationship of Equation 4 is satisfied, for example). For example, a combination of a look-up table that outputs the potential VX using the counted value c1 as an address and a D/A converter is preferably used as the potential generation circuit 423. The filter circuit 425 (e.g., a low-pass filter) is configured to smooth out the step difference of the potential VX output from the potential generation circuit 423. The output signal from the filter circuit 425 is passed to the buffer circuit 427 and then supplied to the respective signal lines 14 as the driving signal X.

The gradation control circuit 44 is configured to include a counter circuit 442 and n unit circuits 446 corresponding to the respective control lines 24. The counter circuit 442 is configured to count a predetermined clock signal and initialize a counted value c2 to zero at the starting point of each of the respective unit time periods H. At the start of the unit time period H[i], the j-th unit circuit 446 is supplied with the j-th gradation D on the i-th row. The j-th unit circuit 446 is configured to set the control signal GT[j] to the active level at the starting point of each of the respective unit time periods H while setting the control signal GT[j] to the non-active level at the point in time when the counted value c2 by the counter circuit 442 reaches the value of the gradation D (namely, the point in time occurring after an elapse of the time length tx corresponding to the gradation D). That is to say, the unit circuits 446 are pulse-width modulation circuits that generate the control signal GT[j] having a pulse width (time length tx) corresponding to the gradation D.

C: Second Embodiment

Next, the second embodiment of the invention will be described. In the following embodiments, those components having the same effects and functions as those of the first embodiment will be denoted by the same reference numerals and the detailed descriptions thereof will be appropriately omitted.

Figure 12:
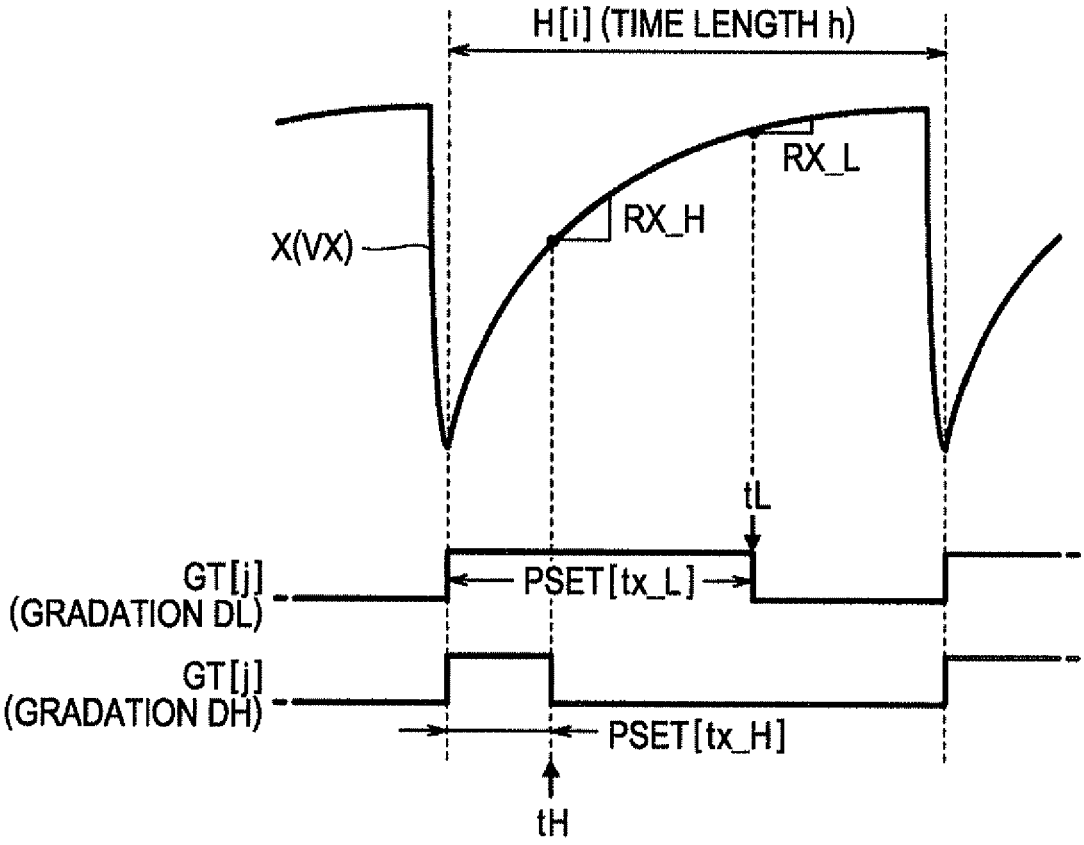
FIG. 12 is a conceptual diagram for explaining the relationship between the length of time of a gradation setting period and the gradation according to a second embodiment of the invention.

FIG. 12 is a timing chart illustrating the relationship between the driving signal X and the control signal GT[j] according to the second embodiment. Similar to FIG. 6, FIG. 12 illustrates the control signals GT[j] when the gradation DH was specified and when the gradation DL was specified. As illustrated in FIG. 12, the driving signal X increases continuously from the starting point to the end point of the respective unit time periods H so that the time rate of change RX of the potential VX decreases over time (in other words, the potential VX draws an upwardly convex curve). For example, the potential VX is defined by Equation 7 below. The constant γ in Equation 7 is chosen so that the time rate of change RX of the potential VX becomes a predetermined value (e.g., Imax/cp1) at the starting point (t=0) of the unit time period H.

$$VX=\gamma\{1-(h-t)^n\} \qquad \text{Equation 7}$$

Similar to the case of the first embodiment, the gradation control circuit 44 is configured to set the time length tx of the gradation setting period PSET during which the control signal GT[j] during the unit time period H[i] is set to the active level to be variable in accordance with the gradation D specified for the pixel circuit U on the i-th row and the j-th column. However, contrary to the first embodiment, the higher the gradation D specified for the pixel circuit U, the shorter the set time length tx of the gradation setting period PSET within the unit time period H becomes. For example, the time length tx_H of the gradation setting period PSET when the gradation DH is specified is shorter than the time length tx_L of the gradation setting period PSET when the gradation DL is specified. Since the time rate of change RX of the potential VX decreases over time, similar to the case of the first embodiment, the time rate of change RX_H at the end point tH of the gradation setting period PSET when the gradation DH is specified is higher than the time rate of change RX_L at the end point tL of the gradation setting period PSET when the gradation DL is specified. Therefore, the same advantages as those of the first embodiment can be achieved in the present embodiment.

D: Initialization of Gate-Source Voltage VGS of Driving Transistor TDR

In the above-described embodiments, in order to allow the driving transistor TDR to change into the equilibrium state by supplying the driving signal X[j], it is necessary to set the gate-source voltage VGS to be higher than the threshold voltage VTH, thereby flowing the current IDS through the driving transistor TDR. However, the gate-source voltage VGS may become lower than the threshold voltage VTH due to various reasons. For example, one reason is that immediately after the light emitting device 100 is powered on, the voltage VGS is in an indefinite state and hence may become lower than the threshold voltage VTH. Another reason for the possibility of the voltage VGS becoming lower than the threshold voltage VTH may be the influence of external disturbance such as noise.

The lower the voltage VGS at the starting point of the unit time period H, compared with the threshold voltage VTH, the longer the period of time elapsed until the voltage VGS reaches the threshold voltage VTH becomes. Therefore, a considerable amount of time may be required for the driving transistor TDR to reach the equilibrium state. The above-mentioned problem becomes particularly obvious when a lower gradation is specified under the condition of the first embodiment, because for low gradations, the amount of change in the gate potential VG within the gradation setting period PSET is small and the time length tx of the gradation setting period PSET during which the potential VG varies is short. For instance, there a case may occur where the driving transistor TDR is unable to reach the equilibrium state within one unit time period H.

In respective embodiments below (third to sixth embodiments), a configuration will be described in which the gate-source voltage VGS of the driving transistor TDR is initialized to a predetermined voltage, thereby reducing the period of time elapsed until the driving transistor TDR is changed to the ON state from the starting point of the unit time period H (namely, the period of time elapsed until the voltage VGS becomes higher than the threshold voltage VTH). Although a configuration where the initialization of the voltage VGS is applied to the first embodiment will be described below, it goes without saying that the same configuration may be similarly applied to the second embodiment.

D-1: Third Embodiment

Figure 13:
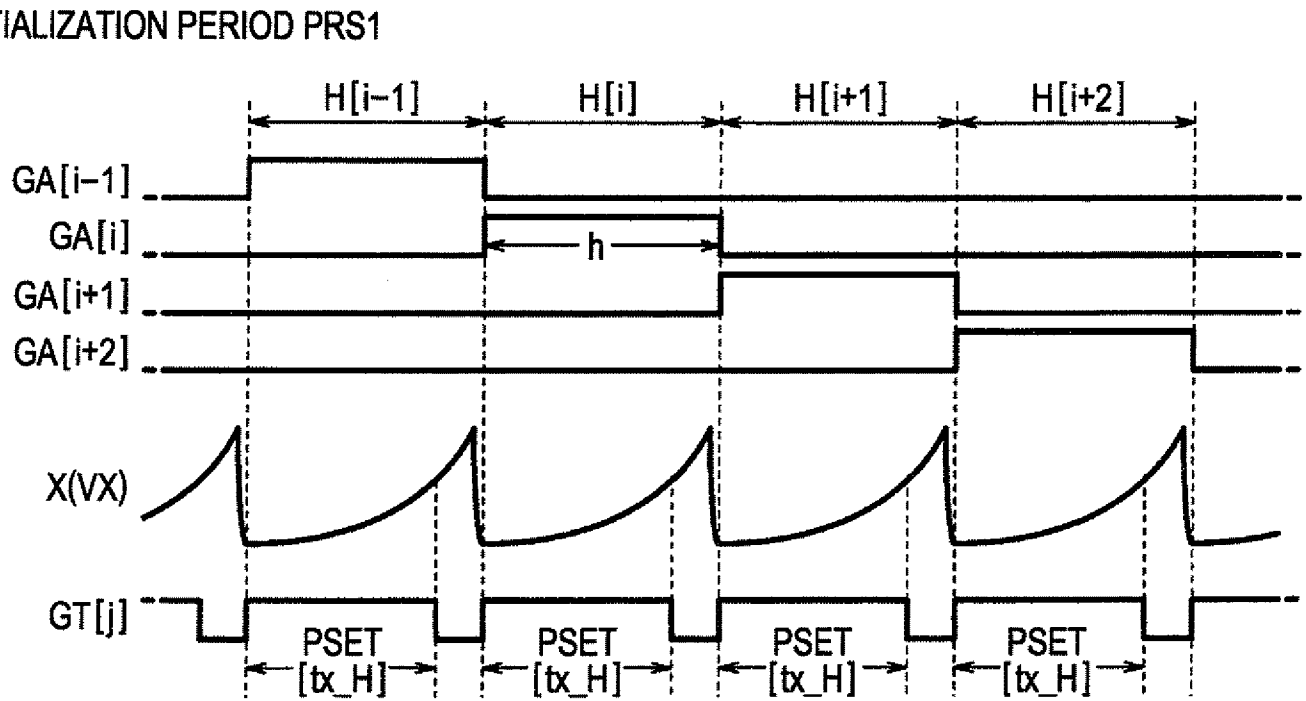
FIG. 13 is a timing chart illustrating the operation within an initialization period according to a third embodiment of the invention.

FIG. 13 is a timing chart illustrating the operation according to the third embodiment of the invention. In FIG. 13, there is illustrated only the operation within a predetermined period (hereinafter, referred to as "initialization period") PRS1 which is set immediately after the light emitting device 100 is powered on. The initialization period PRS1 is a period (for example, one vertical scanning period) for initializing the gate-source voltage VGS of each of the driving transistors TDR of the respective pixel circuits U. The operations of driving the light emitting elements E of the respective pixel circuits U to the gradation corresponding to the specified gradation D after a lapse of the initialization period PRS1 are the same as those of the first embodiment (FIG. 4).

In the initialization period PRS1, the entire pixel circuits U within the device portion 10 are driven similar to the case where a sufficiently high gradation DH (e.g., the maximum gradation corresponding to a white display) is specified. Specifically, the scanning line-driving circuit 32 sequentially sets the scanning signals GA[1] to GA[m] to the active level for every unit time period H, and the signal generation circuit 42 outputs the driving signal X of which the rate of change RX of the potential VX for each of the respective unit time periods H varies over time to the respective signal lines 14. On the other hand, as illustrated in FIG. 13, the gradation control circuit 44 sets the gradation setting period PSET (namely, the pulse width of the control signals GT[1] to GT[n]) to the time length tx_H corresponding to the gradation DH in each of the m unit time periods H[1] to H [m] within the initialization period PRS1.

In the respective unit time periods H within the initialization period PRS1 during which the above-mentioned operations are executed, the potential VG of the gate of the driving transistor TDR varies over a sufficient time length tx_H corresponding to the gradation DH, and the time rate of change RX of the potential VX of the driving signal X is set to a sufficiently high value at the end point of the gradation setting period PSET. Therefore, the voltage VGS of each of the driving transistors TDR of the respective pixel circuits U becomes higher than the threshold voltage VTH.

As described above, the driving transistor TDR of each of the respective pixel circuits U is controlled to be in the ON state during the initialization period PRS1. Therefore, for example, even when the voltage VGS of the driving transistor TDR is lower than the threshold voltage VTH at the point in time when the light emitting device 100 is powered on, since the driving signals X[k] are supplied in the respective unit time periods H occurring after a lapse of the initialization period PRS1 (namely, at the time when the respective pixel circuits U are actually driven in accordance with the gradation D), the current IDS can quickly and with certainty flow through the driving transistor TDR. As a result, it is possible to provide an advantage that the period of time required for the driving transistor TDR to transition to the equilibrium state can be reduced.

D-2: Fourth Embodiment

Figure 14:
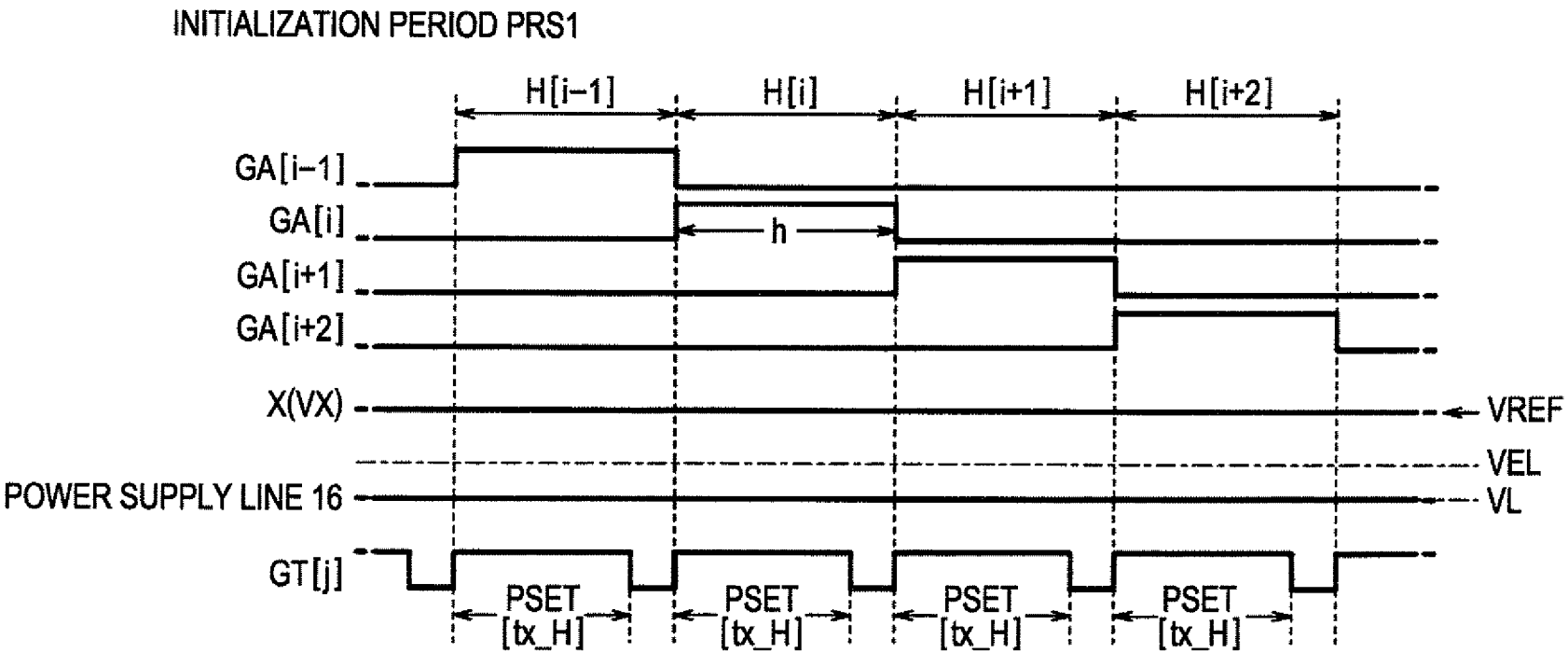
FIG. 14 is a timing chart illustrating the operation within the initialization period according to a fourth embodiment of the invention.

FIG. 14 is a timing chart illustrating the operation (the operation within the initialization period PRS1) according to the fourth embodiment of the invention. Similar to the case of the third embodiment, the operation of initializing the voltage VGS of each of the driving transistors TDR of the respective pixel circuits U is executed in the initialization period PRS1, and then, the same operation as the first embodiment is executed when the initialization period PRS1 has elapsed. The initialization period PRS1 corresponds to one vertical scanning period occurring immediately after the light emitting device 100 is powered on, for example.

As illustrated in FIG. 14, during the initialization period PRS1, the driving signals X supplied to the signal lines 14 are fixed to the predetermined reference potential VREF, and a potential VL is supplied to the power supply line 16. On the other hand, the scanning line-driving circuit 32 sequentially sets the scanning signals GA[1] to GA[m] to the active level for every unit time period H. The gradation control circuit 44 sets the control signals GT[1] to GT[n] to the active level during the gradation setting period PSET having the time length tx_H corresponding to the high gradation DH within the respective unit time periods H. Therefore, during the gradation setting period PSET, the select switches TSL and the control switches TCR1 are controlled to be in the ON state. As a result, the reference potential VREF is supplied from the signal lines 14 to the gates of the driving transistors TDR, and the potential VS of the source of each of the driving transistors TDR is set to the potential VL of the power supply line 16. That is to say, the gate-source voltage VGS (the open circuit voltage of the storage capacitor CST) of the driving transistor TDR is initialized to a voltage (VREF−VL) which is the difference between the reference potential VREF and the potential VL.

The reference potential VREF and the potential VL are chosen so that the voltage, which is the difference between them, is higher than the threshold voltage VTH of the driving transistor TDR (VREF−VL>VTH), and that the open circuit voltage of the light emitting element E is lower than the threshold voltage VTH_OLED of the light emitting element E (VL−VCT<VTH_OLED). Therefore, during the initialization period PRS1, the light emitting elements E of the respective pixel circuits U are maintained in the OFF state (non-emission state), while the driving transistors TDR of the respective pixel circuits U are in the ON state. The reference potential VREF is set to the minimum value of the potential VX (namely, the voltage value at the starting point of the unit time period H) of the driving signal X at the point in time occurring after an elapse of the initialization period PRS1, for example.

In the above-mentioned embodiment, the voltage VGS of each of the driving transistors TDR of the respective pixel circuits U is initialized during the initialization period PRS1 so that the driving transistors TDR are in the ON state. Therefore, similar to the case of the third embodiment, even when the voltage VGS of the driving transistor TDR is lower than the threshold voltage VTH at the point in time when the light emitting device 100 is powered on, it is possible to make sure that the driving transistors TDR quickly transition to the equilibrium state in the respective unit time periods H occurring after a lapse of the initialization period (namely, at the stage in time when the respective pixel circuits U are actually driven in accordance with the gradations D).

D-3: Fifth Embodiment

Figure 15:
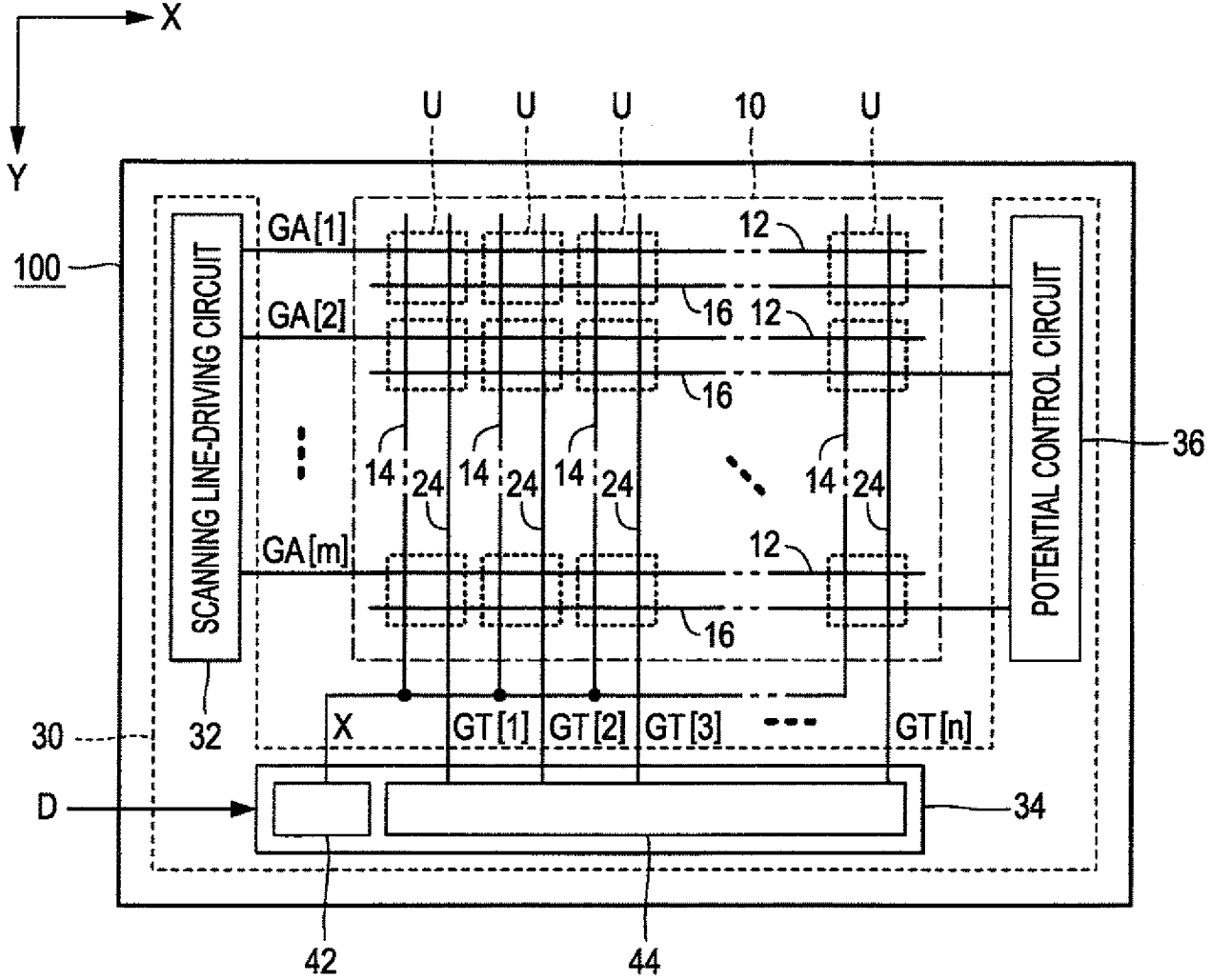
FIG. 15 is a block diagram of a light emitting device according to a fifth embodiment of the invention.

FIG. 15 is a block diagram of the light emitting device 100 according to the fifth embodiment of the invention. In the device portion 10 of the light emitting device 100 illustrated in FIG. 15, m power supply lines 16 extending in the X direction together with the respective scanning lines 12 are formed. The driving circuit 30 includes a potential control circuit 36 configured to individually control the potential of each of the m power supply lines 16. Other configurations are the same as those of FIG. 3.

Figure 16:
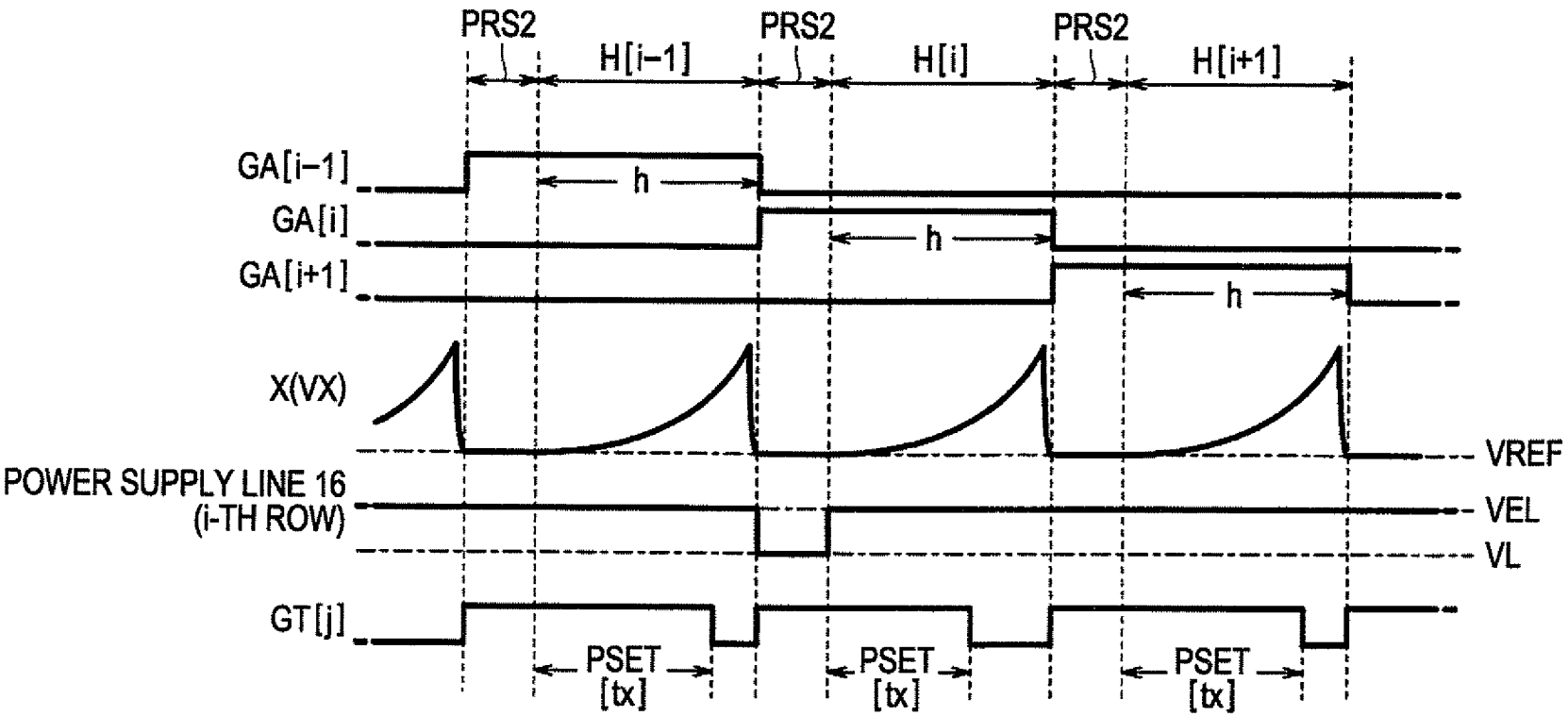
FIG. 16 is a timing chart illustrating the operation of the light emitting device according to the fifth embodiment.

FIG. 16 is a timing chart illustrating the operation according to the present embodiment. Although in the third or fourth embodiment, the initialization period PRS1 is set to occur immediately after the light emitting device 100 is powered on, in the present embodiment, the voltage VGS of each of the driving transistors TDR in the respective pixel circuits U on the i-th row is initialized during an initialization period PRS2 that is set within the respective unit time periods H[i].

During the previous initialization period PRS2 to the unit time period H[i], the scanning signal GA[i] is set to the active level and the potential VX of the driving signal X is set to the reference potential VREF. The potential control circuit 36 supplied the potential VL to the power supply line 16 on the i-th row, and the gradation control circuit 44 sets the control signals GT[1] to GT[n] to the active level. Therefore, similar to the case of the fourth embodiment, the voltage VGS of each of the driving transistors TDR in the respective pixel circuits U on the i-th row is initialized to a voltage (VREF−VL) which is the difference between the reference potential VREF supplied to the gates thereof and the potential VL supplied to the source thereof. The requirements of the reference potential VREF or the potential VL are the same as those of the fourth embodiment. For example, the reference potential VREF is set to the minimum value of the potential VX. Moreover, the operations performed during the respective unit time periods H are the same as those of the first embodiment.

In the above-mentioned embodiment, the same advantages as those of the third or fourth embodiment can be achieved. Additional advantage of the present embodiment is that, because the voltage VGS of each of the driving transistors TDR is initialized for every unit time period H, the driving current IDR which is set in the unit time periods H[i] is not affected by the specified gradations D during the unit time periods H[i] of the previous vertical scanning period, as will be described later.

Now, a case will be considered where under the conditions of the first embodiment where no initialization period PRS2 is set, the gradation D specified for one pixel circuit U varies from the maximum value (the maximum gradation corresponding to a white display) to the minimum value (the minimum gradation corresponding to a black display). The time length tx of the gradation setting period PSET of the unit time period H[i] in which the gradation D is set to the minimum value is set to the shortest. On the other hand, the voltage VGS (VSET) of the driving transistor TDR during the previous unit time period H[i] to the unit time period in which the gradation D is set to the maximum value is set to the maximum value. Therefore, there is a possibility that, the voltage VGS of the driving transistor TDR does not completely fall up to the voltage corresponding to the minimum value of the gradation D until the end point of the gradation setting period PSET having the shortest time length tx corresponding to the minimum value of the gradation D. Therefore, in some cases, the driving current IDR is supplied to the light emitting elements E despite of the fact that the gradation D is set to the minimum value, thereby lowering the contrast of displayed images.

In the present embodiment, since the voltage VGS of the driving transistor TDR is initialized to the predetermined value (VREF−VL) during the initialization period PRS2 previous to the respective unit time periods H[i], it is possible to provide an advantage that the voltage VGS of the driving transistor TDR can be accurately set to the voltage VSET corresponding to the present gradation D independent of the voltage VGS set during the previous unit time period H[i] (namely, independent of the previous gradation D).

D-4: Sixth Embodiment

Figure 17:
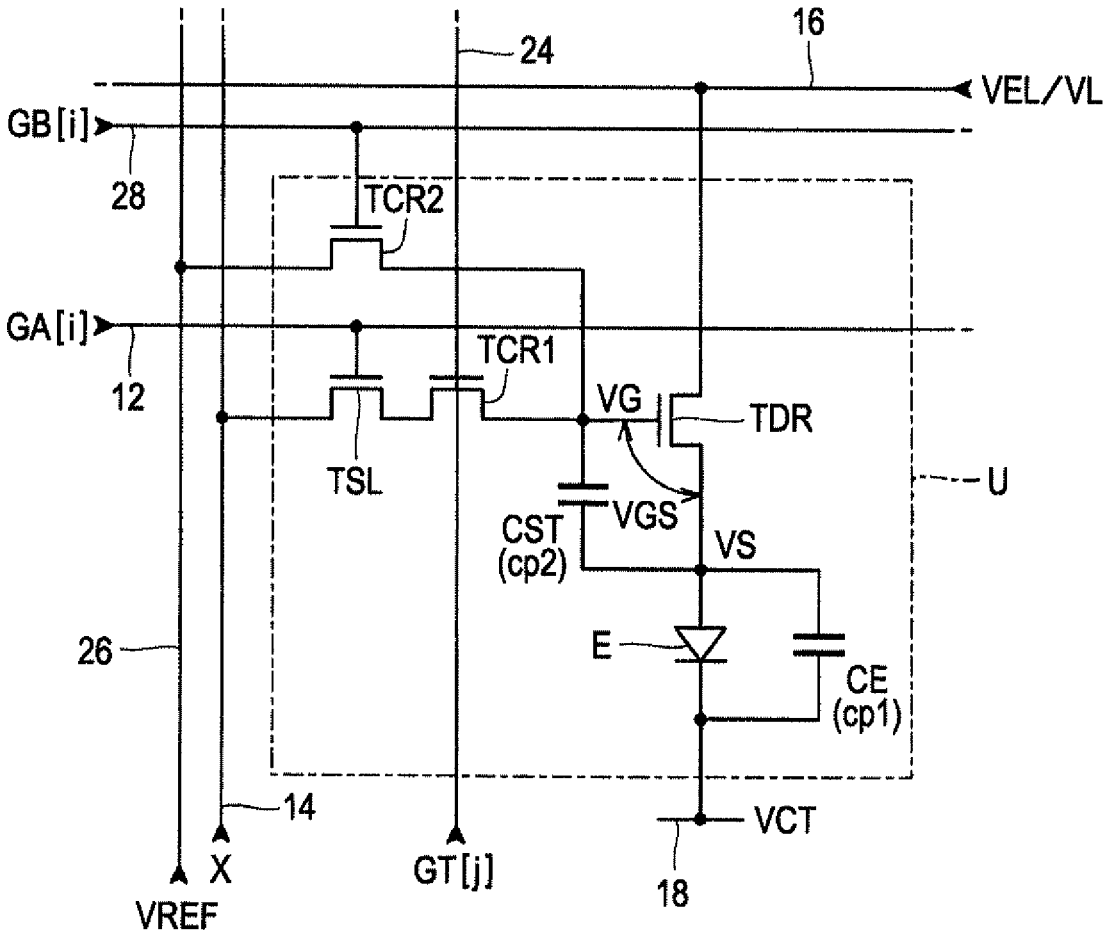
FIG. 17 is a circuit diagram of a pixel circuit according to a sixth embodiment of the invention.

FIG. 17 is a circuit diagram of a pixel circuit U according to the sixth embodiment of the invention. As illustrated in FIG. 17, the pixel circuit U corresponds to a configuration in which a control switch TCR is added to the pixel circuit U according to the first embodiment. The control switch TCR2 is an N-channel transistor that is disposed between the gate of the driving transistor TDR and a power supply line 26 so as to control an electrical connection (conduction/non-conduction) between them. The power supply line 26 is supplied with the reference potential VREF. In the fourth or fifth embodiment, the signal line 14 is also used for supplying the reference potential VREF to the pixel circuits U. However, in the present embodiment, the power supply line 26 that is provided to be separate from the signal line 14 is used for supplying the reference potential VREF to the respective pixel circuits U.

In the device portion 10, m control lines 28 extending in the X direction together with the scanning lines 12 are formed. As illustrated in FIG. 17, the gate of the control switch TCR2 in each of the respective pixel circuits U on the i-th row is connected to the control line 28 on the i-th row. The respective control lines 28 are supplied with control signals GB (GB[1] to GB[m]) from the driving circuit 30 (for example, the scanning line-driving circuit 32).

Figure 18:
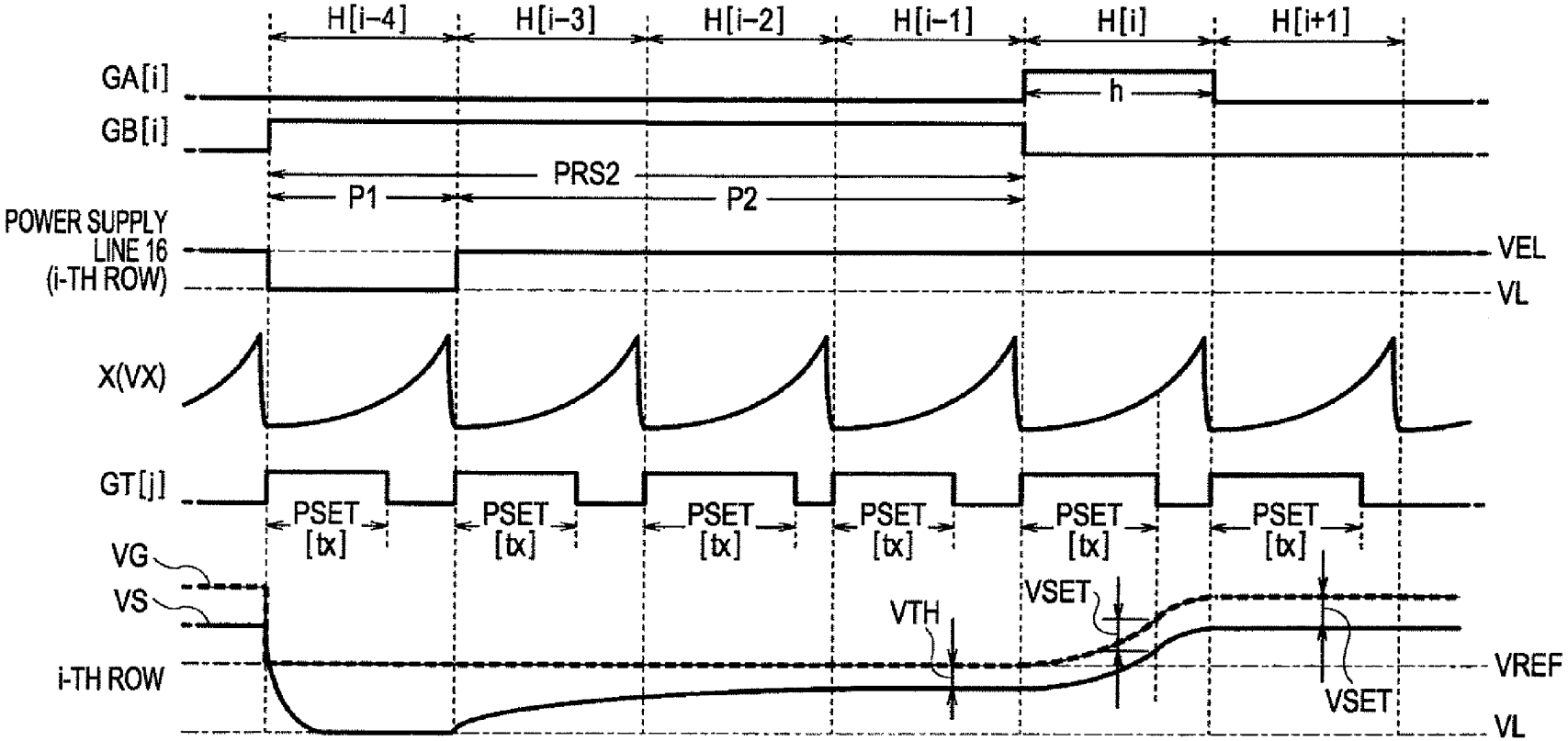
FIG. 18 is a timing chart illustrating the operation of the light emitting device according to the sixth embodiment.

FIG. 18 is a timing chart for explaining the method for driving the pixel circuit U. The operation of setting the voltage VGS of the driving transistor TDR to the voltage VSET corresponding to the gradation D in the respective unit time periods H[i] or the operation of supplying the driving current IDR corresponding to the voltage VSET to the light emitting device E at the point in time occurring after an elapse of the unit time period H[i] is the same as that of the first embodiment. In the present embodiment, the operation of initializing the voltage VGS of each of the driving transistors TDR of the respective pixel circuits U on the i-th row are executed using a plurality of unit time periods (unit time periods H[i-4] to H[i-1]) occurring before the unit time period H[i] as the initialization period PRS2. The initialization period PRS2 is divided into period P1 (unit time period H[i-4]) and period P2 (unit time H [i-3] to H[i-1]).

The control signal GB[i] is set to the active level during the initialization period PRS2 (unit time periods H[i-4] to H[i-1]) for the i-th row and is maintained at the non-active level during other periods. When the control signal GB[i] is set to the active level, the control switch TCR2 in each of the respective pixel circuits U on the i-th row is changed to the ON state. Therefore, as illustrated in FIG. 18, the potential VG of the gate of the driving transistor TDR is set to the reference potential VREF which is supplied from the power supply line 26 via the control switch TCR2.

As illustrated in FIG. 18, during the period P1 (unit time period H[i-4]) of the initialization period PRS2 for the i-th row, the potential VL is supplied to the power supply line 16 on the i-th row. Therefore, similar to the case of the fifth embodiment, the voltage VGS of each of the driving transistors TDR in the respective pixel circuits U on the i-th row is initialized to the voltage (VREF−VL) which is the difference between the reference potential VREF supplied to the gates thereof and the potential VL supplied to the sources thereof. Since the relationship between the reference potential VREF and the potential VL is chosen similar to the case of the fourth or fifth embodiment, the driving transistor TDR is controlled to be in the ON state during the period P1.

When the period P2 (unit time periods H[i-3] to H[i-1]) begins, the potential control circuit 36 supplies the potential VL to the power supply line 16. Since the driving transistor TDR has transitioned to the ON state during the period P1, under such a state, the current IDS as expressed by Equation 1 flows between the drain and the source of the driving transistor TDR, whereby electric charges are stored in the capacitor CE and the storage capacitor CST. Therefore, as illustrated in FIG. 18, the potential VS of the source of the driving transistor TDR increases over time. Since the gate of the driving transistor TDR is continuously supplied with the reference potential VREF from the period P1, the voltage VGS of the driving transistor TDR falls with the increase in the source potential VS. As can be understood from Equation 1, the current IDS decreases as the voltage VGS decreases to approach the threshold voltage VTH. Therefore, in the period P2, the voltage VGS of the driving transistor TDR is caused to approach the threshold voltage VTH from the voltage (VREF−VL) after initialization during the period P1. The time length (the number of unit time periods H) of the period P2 is set so that the voltage VGS of the driving transistor TDR sufficiently approaches (ideally, becomes identical to) the threshold voltage VTH at the end point of the period P2. Although the above description has been made with particular attention to the pixel circuits U disposed on the i-th row, the same operations are repeated for the pixel circuits U disposed on the respective rows.

As described above, in the present embodiment, the gate-source voltage VGS of the driving transistor TDR is initialized to the threshold voltage VTH before the driving signal X is supplied (namely, before the unit time period H[i] begins). Therefore, it is possible to cause the potential VS of the source of the driving transistor TDR to vary with the gate potential VG (the potential VX of the driving signal X) at the point in time during the unit time period H[i] occurring immediately after the driving signal X starts to be supplied. Accordingly, it is possible to provide an advantage that the voltage VGS of the driving transistor TDR can be accurately set to the voltage VSET corresponding to the present gradation D independent of the voltage VSET set during the previous unit time period H[i] (namely, independent of the previous gradation D).

Moreover, although in the sixth embodiment, the gate-source voltage VGS of the driving transistor TDR was set to the threshold voltage VTH during the initialization period PRS2, it is not necessary to cause the voltage VGS to approach directly to the threshold voltage VTH. That is to say, it is desirable to have a configuration in which the voltage VGS of the driving transistor TDR is caused to approach from the voltage VGS1 set by the initialization operation to the threshold voltage VTH.

E: Modifications

The above-described embodiments can be modified in various ways. Specific examples of modifications of the embodiments will be described. Two or more modifications may be chosen arbitrarily from the examples below and be combined with each other.

(1) Modification 1

Figure 19:
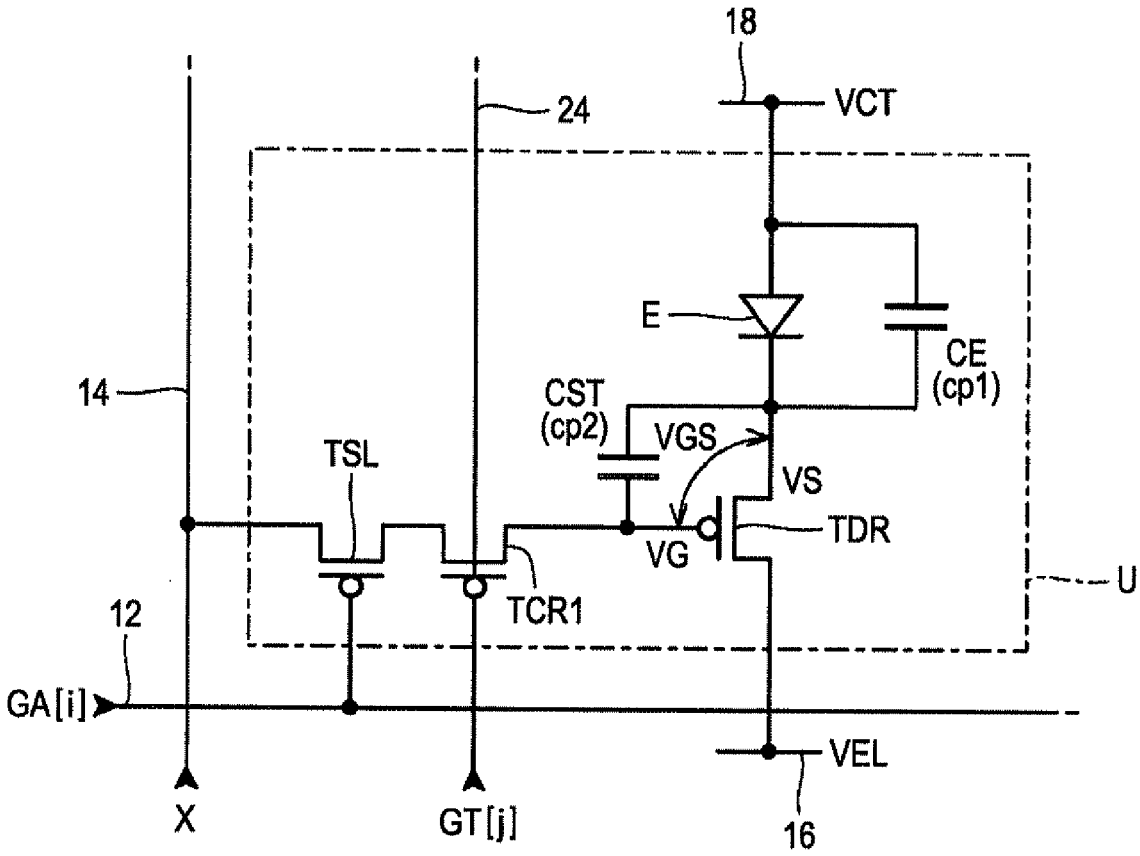
FIG. 19 is a circuit diagram of a pixel circuit according to a modification.

The conduction types of the respective transistors (the driving transistor TDR, the select switch TSL, the control switch TCR1, and the control switch TCR2) constituting the pixel circuit U are arbitrary. For example, a configuration as illustrated in FIG. 19 may be employed in which the driving transistor TDR and the respective switches (the select switch TSL and the control switch TCR1) are formed of P-channel transistors. In the pixel circuit U illustrated in FIG. 19, the anode of the light emitting element E is connected to the power supply line 18 (at potential VCT), and the driving transistor TDR has a drain thereof being connected to the power supply line 16 (at potential VEL) and a source thereof being connected to the cathode of the light emitting element E. The configuration where the storage capacitor CST is disposed between the gate and the source of the driving transistor TDR and the configuration where the select switch TSL and the control switch TCR1 are disposed in series between the gate of the driving transistor TDR and the signal line 14 are the same as those illustrated in FIG. 4. When the P-channel driving transistor TDR is employed as described above, the relationship (amplitude relationship) of voltage is opposite to the case of employing the N-channel driving transistor TDR. However, the essential operations are similar to those of the above-described embodiments, and detailed description of the operations will be omitted.

(2) Modification 2

Figure 20:
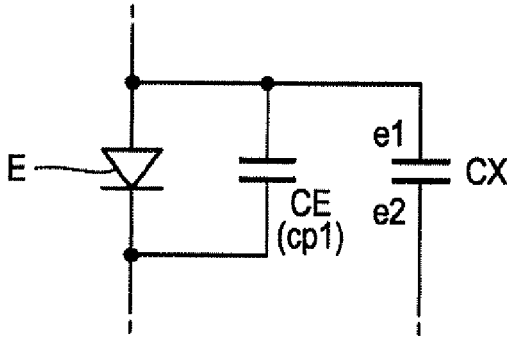
FIG. 20 is a circuit diagram of a part of the pixel circuit according to a modification.

Although in the above-described embodiments, the capacitor CE associated with the light emitting element E was used, it is also desirable to have a configuration where a capacitor CX formed separately from the light emitting element E is used together with the capacitor CE, as illustrated in FIG. 20. An electrode e1 of the capacitor CX is connected to a path (the source of the driving transistor TDR) that connects the driving transistor TDR and the light emitting element E. An electrode e2 of the capacitor CX is connected to a line to which a predetermined potential is supplied (for example, the power supply line 18 supplied with the potential VCT or the power supply line 26 in FIG. 17, supplied with the reference potential VREF). In the configuration illustrated in FIG. 20, the capacitance cp1 in the above-described embodiments corresponds to the sum of the capacitance of the capacitor CX and the capacitance of the capacitor CE of the light emitting element E. Therefore, it is possible to appropriately adjust the current IDS (and the driving current IDR) given by Equation 2 or 3 in accordance with the capacitance of the capacitor CX.

(3) Modification 3

Similar to the case of the above-described embodiments, when the respective pixel circuits U are driven on a row-by-row basis based on time division multiplexing in the configuration where a plurality of pixel circuits U is arranged in matrix, it is necessary to have the select switch TSL in the respective pixel circuits U. However, in a configuration where a plurality of pixel circuits U is arranged in one column along the X direction, for example, since the operation of selecting a plurality of rows by the time division multiplexing is not required, the select switch TSL in the pixel circuits U is not necessary. The light emitting device 100 in which a plurality of pixel circuits U is arranged in only one column is desirably employed as an exposure device that exposes an image carrier such as a photosensitive drum in an electrophotographic image forming apparatus (a printing apparatus), for example. Moreover, in a configuration where a plurality of pixel circuits U is arranged in one column along the X direction, the control switch TCR1 may be disposed within the signal line-driving circuit 34 (the gradation control circuit 44). In other words, as long as the supply of the driving signal X to the gate of the driving transistor TDR is controlled, whether or not the control switch TCR1 is disposed in the pixel circuit U is not particularly limited in the invention.

(4) Modification 4

The starting timings or the triggering signals of the operation of initializing the gate-source voltage VGS of the driving transistor TDR are changed arbitrarily. For example, a configuration where the initialization operation is executed once every a plurality of vertical scanning periods, or a configuration where the initialization operation is executed in response to instructions, as the triggering signals, from the user issued to the light emitting device 100 may be employed. The configuration (the fifth or sixth embodiment) where the voltage VGS is frequently initialized during driving (e.g., every unit time period H) of the respective pixel circuits U, thereby eliminating the effect of the previous gradation D is particularly desirable when the specified gradation D varies over time (that is, when moving pictures are displayed). Therefore, a configuration may be employed in which, when moving pictures are displayed, the voltage VGS is frequently initialized during driving (the initialization period PRS2) of the pixel circuit U, while, when still images are displayed, the voltage VGS is initialized only immediately after the light emitting device 100 is powered on.

(5) Modification 5

Although in the above-described embodiments, the common driving signals X were supplied to the n signal lines 14 which are formed to be independent for each column of the pixel circuits U, the number of signal lines 14 may be changed appropriately. For example, a configuration where one signal line 14 is used for supplying the driving signal X to a plurality of columns of the respective pixel circuits U (namely, a configuration where the signal lines 14 are formed for a predetermined number of columns) may be employed. Moreover, although in the above-described embodiments, the driving signal X generated by one signal generation circuit 42 was supplied to the entire signal lines 14, from the viewpoint of reducing the output load of one signal generation circuit 42, it may be desirable to have a configuration where the signal generation circuits 42 are disposed for a predetermined number (single or plural) of signal lines 14 to individually generate the driving signals X.

For example, when the capacitances cp1 of the capacitors CE of the light emitting elements E or the light emission efficiencies of the light emitting elements E are different for each column, or when the colors (red, green, and blue) displayed by the light emitting elements E are different for each column, there is a possibility that the time rates of change RX required for the respective pixel circuits U to generate a desired driving current IDR are different for each column. Therefore, a configuration where a plurality of driving signals X of which the changes (waveform) over time of the potential VX are different are individually supplied to the respective signal lines 14 may be employed.

In the configuration (e.g., the first embodiment) where the common driving signal X is supplied to the respective signal lines 14, it is necessary to individually adjust the pulse width (the time length tx of the gradation setting period PSET) of the control signal GT[j] for each column so that the driving currents IDR in the respective pixel circuits U are adjusted for each column. Therefore, it is necessary to prepare a number of kinds of pulse widths of the control signal GT[j]. On the other hand, in a configuration where the driving signals X are individually supplied for each column, since the driving currents IDR in the respective pixel circuits U are adjusted for each column even when the step size of the pulse width of the control signal GT[j] is identical over the entire columns, it is possible to reduce the number of kinds of the pulse widths required for the control signal GT[j] (namely, the step size of the pulse width can be increased). Therefore, it is possible to provide an advantage that the configuration or the operation of the gradation control circuit 44 can be simplified, and that the effect of the distortion of the waveform of the control signal GT[j] can be reduced. In addition, as an example of a configuration of supplying individual driving signals X to each of the signal lines 14, it is desirable to have a configuration in which any one of a plurality of kinds of driving signals X of which the changes over time of the potential VX are different is selected to be output to the respective signal lines 14.

(6) Modification 6

An organic EL element is merely an example of the light emitting element. For example, similar to the above-described embodiments, the invention is applicable to a light emitting device in which light emitting elements such as inorganic EL elements or light emitting diode (LED) elements are arranged. The light emitting element used in the invention is a current-driven element which is driven by a current supplied thereto (typically, a gradation (luminance) is controlled).

F: Applications

Figure 21:
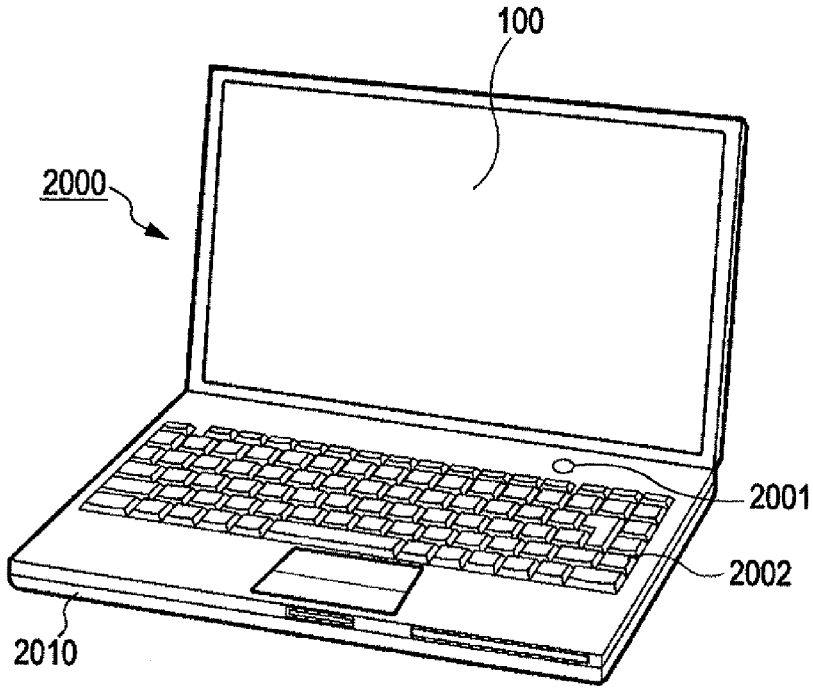
FIG. 21 is a perspective view of an electronic apparatus (personal computer).
Figure 22:
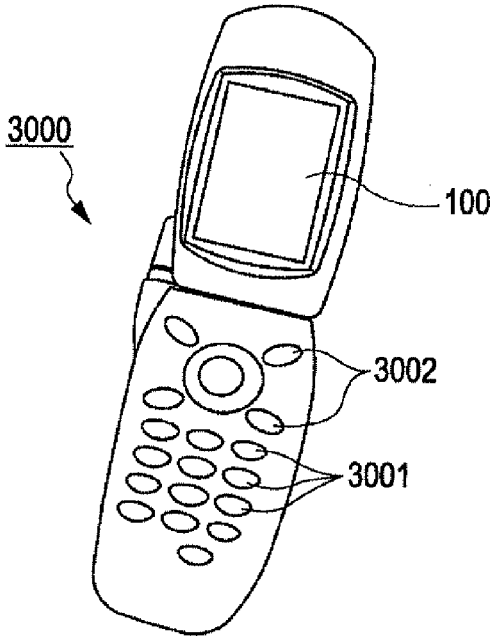
FIG. 22 is a perspective view of an electronic apparatus (cellular phone).
Figure 23:
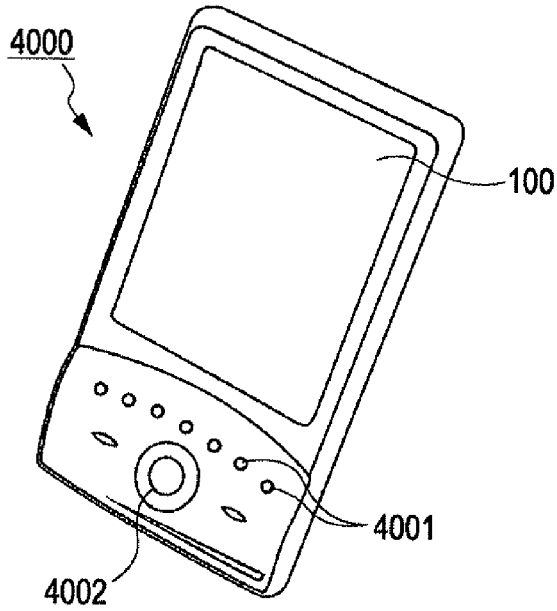
FIG. 23 is a perspective view of an electronic apparatus (personal digital assistant).

Next, an electronic apparatus that utilizes the light emitting device 100 according to the above-described embodiments will be described. FIGS. 21 to 23 illustrate embodiments of an electronic apparatus in which the light emitting device 100 is employed as a display device.

FIG. 21 is a perspective view illustrating the configuration of a mobile personal computer that utilizes the light emitting device 100. A personal computer 2000 includes the light emitting device 100 for displaying various images and a main unit 2010 on which a power switch 2001 and a keyboard 2002 are provided. Because the light emitting device 100 uses an organic EL element as the light emitting element E, the light emitting device 100 can display an easily visible screen with a wide viewing angle.

FIG. 22 is a perspective view illustrating the configuration of a cellular phone to which the light emitting device 100 is applied. A cellular phone 3000 includes a plurality of control buttons 3001, a plurality of scroll buttons 3002, and the light emitting device 100 for displaying various images. By controlling the scroll buttons 3002, a screen displayed on the light emitting device 100 is scrolled.

FIG. 23 is a perspective view illustrating the configuration of a personal digital assistant (PDA) to which the light emitting device 100 is applied. A PDA 4000 includes a plurality of control buttons 4001, a power switch 4002, and the light emitting device 100 for displaying various images. When the power switch 4002 is controlled, various types of information, such as an address book or a schedule book, are displayed on the light emitting device 100.

Examples of the electronic apparatus to which the light emitting device 100 according to an embodiment of the invention is applied include the electronic apparatuses illustrated in FIGS. 21 to 23. Additionally, the examples include, for example, a digital still camera, a television set, a video camera, a car navigation system, a pager, a digital diary, an electronic paper, a calculator, a word processor, a workstation, a videophone, a point-of-sales (POS) terminal, a printer, a scanner, a copier, a video player, and an apparatus provided with a touch panel. Furthermore, the application of the light emitting device 100 according to an embodiment of the invention is not limited to displaying of images. For example, the light emitting device 100 according to an embodiment of the invention can be utilized as an exposure device that forms, by exposure, latent images on a photosensitive drum in an electrophotographic image forming apparatus.

What is claimed is:

1. A method of driving a pixel circuit including a light emitting element and a driving transistor which are connected in series, and a storage capacitor disposed between a path between the light emitting element and the driving transistor and a gate of the driving transistor, the method comprising:

supplying a driving signal to the gate of the driving transistor, a time rate of change of a potential of the driving signal varying over time;

stopping the supply of the driving signal at a first time point which is set to be variable in accordance with a gradation specified for the pixel circuit;

setting a first voltage between the gate of the driving transistor and a source of the driving transistor in accordance with a mobility of the driving transistor and a threshold voltage of the driving transistor by flowing a current between a drain of the driving transistor and the source of the driving transistor based on a first time rate of change of a potential of the driving signal at the first time point; and supplying a driving current to the light emitting element, the driving current proportional to the first voltage.

2. The method according to claim 1, the time rate of change of the potential of the driving signal increasing over time, and the supply of the driving signal stopping at a later time for a first gradation than for a second gradation lower than the first gradation.

3. The method according to claim 2, the rate of change of the time rate of change of the potential of the driving signal increasing over time.

4. The method according to claim 1, the time rate of change of the potential of the driving signal decreasing over time, and the supply of the driving signal stopping at an earlier time for a first gradation than for a second gradation lower than the first gradation.

5. The method according to claim 1, further comprising:

initializing an open circuit voltage of the storage capacitor.

6. The method according to claim 1, further comprising:

initializing an open circuit voltage of the storage capacitor by supplying the driving signal to the gate of the driving transistor and stopping the supply of the driving signal at a time corresponding to a high gradation.

7. The method according to claim 1, further comprising:

initializing an open circuit voltage of the storage capacitor by supplying a reference potential to the gate of the driving transistor from a signal line for supplying the driving signal, and supplying a predetermined potential to the source of the driving transistor.

8. The method according to claim 1, further comprising:

supplying a reference potential to the gate of the driving transistor; and controlling the driving transistor to be in an ON state, so that an open circuit voltage of the storage capacitor approaches a threshold voltage of the driving transistor before supplying the driving signal.

9. A light emitting device comprising:

a pixel circuit including a light emitting element and a driving transistor which are connected in series, a storage capacitor disposed between a path between the light emitting element and the driving transistor and a gate of the driving transistor, and a control switch disposed between the gate of the driving transistor and a signal line; and a driving circuit configured to supply a driving signal to the signal line, control the control switch to be in an ON state to supply the driving signal to the gate of the driving transistor, and control the control switch to be in an OFF state at a first time point which is set to be variable in accordance with a gradation specified for the pixel circuit, a time rate of change of a potential of the driving signal varying over time, the pixel circuit being configured such that a first voltage between the gate of the driving transistor and a source of the driving transistor is set in accordance with a mobility of the driving transistor and a threshold voltage of the driving transistor by flowing a current between a drain of the driving transistor and the source of the driving transistor based on a first time rate of change of a potential of the driving signal at the first time point, and that a driving current is supplied to the light emitting element, the driving current proportional to the first voltage.

10. The light emitting device according to claim 9, the driving circuit increasing over time the time rate of change of the potential of the driving signal, and controlling the control switch to be in the OFF state at a later time for a first gradation than for a second gradation lower than the first gradation.

11. The light emitting device according to claim 9, the driving circuit decreasing over time the time rate of change of the potential of the driving signal, and controlling the control switch to be in the OFF state at an earlier time for a first gradation than for a second gradation lower than the first gradation.

12. An electronic apparatus having the light emitting device according to claim 9.

13. A light emitting device comprising:

a device portion in which a plurality of pixel circuits is arranged so as to correspond to each intersection of a plurality of scanning lines and a plurality of signal lines, each of the plurality of pixel circuits including a light emitting element and a driving transistor which are connected in series, a storage capacitor disposed between a path between the light emitting element and the driving transistor and a gate of the driving transistor, a control switch disposed between the gate of the driving transistor and the signal line, and a select switch disposed between the gate of the driving transistor and the signal line so as to be conductive during selection of the scanning line; and a driving circuit configured to sequentially select, for every unit time period, each of the plurality of scanning lines so as to supply a driving signal to the respective signal lines within each of the unit time periods, control the control switch of each of the respective pixel circuits corresponding to the scanning line to be in an ON state during the unit time period when the scanning line is selected, and the control switch to be in an OFF state at a first time point which is set to be variable in accordance with a gradation specified for the pixel circuit, a time rate of change of a potential of the driving signal varying over time, the device portion being configured such that a first voltage between the gate of the driving transistor and a source of the driving transistor is set in accordance with a mobility of the driving transistor and a threshold voltage of the driving transistor by flowing a current between a drain of the driving transistor and the source of the driving transistor based on a first time rate of change of a potential of the driving signal at the first time point, and that a driving current is supplied to the light emitting element, the driving current proportional to the first voltage.

14. The light emitting device according to claim 13, the driving circuit supplying the same driving signal to each of the plurality of signal lines.

15. The light emitting device according to claim 13, further comprising a control line capable of controlling the control switches of two or more pixel circuits corresponding to the signal line, the control line and the signal line extending in a direction intersecting an extending direction of the scanning lines.

16. The light emitting device according to claim 13, wherein during two or more unit time periods before the start of a unit time period for selecting one scanning line among the plurality of scanning lines, the driving circuit supplies a reference potential from a power supply line to the gate of each of the driving transistors of the respective pixel circuits corresponding to the one scanning line and controls the driving transistors to be in an ON state, thereby causing the open circuit voltage of the storage capacitor to approach a threshold voltage of each of the driving transistors.

17. A method of driving a pixel circuit including a light emitting element and a driving transistor which are connected in series, and a storage capacitor disposed between a path between the light emitting element and a driving transistor and the gate of the driving transistor, the method comprising:

supplying a driving signal to a gate of the driving transistor, having a potential whose time gradient varies over time;

stopping the supply of the driving signal at a first time point when the time gradient of the potential equals a value corresponding to a gradation of the pixel circuit;

setting a first voltage between the gate of the driving transistor and a source of the driving transistor in accordance with a mobility of the driving transistor and a threshold voltage of the diving transistor by flowing a current between a drain of the driving transistor and the source of the driving transistor based on a first time rate of change of a potential of the driving signal at the first time point; and supplying a driving current to the light emitting element, the driving current proportional to the first voltage.

18. The method according to claim 17, the driving current being dependent only on the time gradient of the potential when the supply of the driving signal is stopped and a capacitance of the storage capacitor.

19. The method according to claim 17, the driving current being independent of any physical characteristic of the driving transistor.

20. A light emitting device comprising:

a pixel circuit including a light emitting element and a driving transistor which are connected in series, a storage capacitor disposed between a path between the light emitting element and the driving transistor and a gate of the driving transistor, and a control switch disposed between the gate of the driving transistor and a signal line; and a driving circuit configured to supply a driving signal to the signal line, having a potential whose time gradient varies over time, control the control switch to be in an ON state to supply the driving signal to the gate of the driving transistor, and control the control switch to be in an OFF state at a first time point when the time gradient of the potential equals a value corresponding to a gradation of the pixel circuit, so that a first voltage between the gate of the driving transistor and a source of the driving transistor is set in accordance with a mobility of the driving transistor and a threshold voltage of the driving transistor by flowing a current between a drain of the driving transistor and the source of the driving transistor based on a first time rate of change of a potential of the driving signal at the first time point and that a driving current is supplied to the light emitting element that is proportional to the first voltage.

21. The light emitting device according to claim 20, the storage capacitor having an open circuit voltage so as to induce the driving current to the light emitting element that is proportional to the time gradient of the potential when the supply of the driving signal is stopped.

22. The light emitting device according to claim 20, the storage capacitor having an open circuit voltage so as to induce the driving current to the light emitting element that is proportional to the time gradient of the potential when the supply of the driving signal is stopped and proportional to a capacitance of the storage capacitor.

* * * * *